US009659430B2

(12) United States Patent
Nicely et al.

(10) Patent No.: US 9,659,430 B2
(45) Date of Patent: May 23, 2017

(54) GAMING SYSTEM AND METHOD PROVIDING GAME WITH MULTIPLE AWARD DISPLAYS

(71) Applicant: IGT, Las Vegas, NV (US)

(72) Inventors: Mark C. Nicely, Daly City, CA (US); Jon Leupp, Orinda, CA (US); Timothy L. Isaacson, Alameda, CA (US); Leandro Basallo, San Francisco, CA (US); Scott A. Caputo, Santa Clara, CA (US)

(73) Assignee: IGT, Las Vegas, NV (US)

( * ) Notice: Subject to any disclaimer, the term of this patent is extended or adjusted under 35 U.S.C. 154(b) by 198 days.

(21) Appl. No.: 14/027,866

(22) Filed: Sep. 16, 2013

(65) Prior Publication Data

US 2015/0080087 A1 Mar. 19, 2015

(51) Int. Cl.
*G07F 17/32* (2006.01)
*G07F 17/34* (2006.01)

(52) U.S. Cl.
CPC ..... *G07F 17/3211* (2013.01); *G07F 17/32* (2013.01); *G07F 17/3258* (2013.01); *G07F 17/34* (2013.01)

(58) Field of Classification Search
CPC .. G07F 17/32; G07F 17/3213; G07F 17/3267; G07F 17/3211; G07F 17/34; A63F 2/00157; A63F 5/00
See application file for complete search history.

(56) References Cited

U.S. PATENT DOCUMENTS

| | | | |
|---|---|---|---|
| 2,545,644 | A | 3/1951 | Benton et al. |
| 3,633,915 | A | 1/1972 | Lippert |
| 4,410,178 | A | 10/1983 | Partridge |
| 4,560,161 | A | 12/1985 | Hamano |
| 4,624,459 | A | 11/1986 | Kaufman et al. |
| 4,695,053 | A | 9/1987 | Vazquez et al. |
| 4,732,386 | A | 3/1988 | Rayfiel |
| 4,756,531 | A | 7/1988 | Dire et al. |
| 4,941,665 | A | 7/1990 | Klamer |

(Continued)

FOREIGN PATENT DOCUMENTS

| | | |
|---|---|---|
| AU | 1997 16432 | 10/1999 |
| DE | 8710757 | 11/1987 |

(Continued)

OTHER PUBLICATIONS

Aristocrat—US | Tarzan of the Apes™, available at http://www.aristocrat-us.com/#!tarzan-of-the-apes/ceoh, Sep. 4, 2014 (1 page).

*Primary Examiner* — Kang Hu
*Assistant Examiner* — Malina D Blaise
(74) *Attorney, Agent, or Firm* — Neal, Gerber & Eisenberg LLP

(57) ABSTRACT

A gaming system and method which provides multiple individually and independently activated un-weighted award displays, wherein a plurality of designated awards have the same probability of being won regardless of how many of the award displays are activated. In various embodiments, the designated awards are different, and in various embodiments, the designated awards are progressive awards. In various embodiments, the un-weighted award displays include a plurality of award wheels.

30 Claims, 10 Drawing Sheets

(56) References Cited

U.S. PATENT DOCUMENTS 5,184,821 A 2/1993 Korenek et al.
5,205,555 A 4/1993 Hamano
5,280,909 A 1/1994 Tracy et al.
5,342,047 A 8/1994 Heidel
5,344,144 A 9/1994 Canon et al.
5,344,145 A 9/1994 Chadwick et al.
5,362,052 A 11/1994 Kubatsch
5,364,104 A 11/1994 Jones et al.
5,407,200 A 4/1995 Zalabak
5,449,173 A 9/1995 Thomas et al.
5,490,670 A 2/1996 Hobert et al.
5,501,455 A 3/1996 Hirata et al.
5,722,891 A 3/1998 Inoue
5,788,573 A * 8/1998 Baerlocher ..... G07F 17/32 273/138.2
5,823,874 A 10/1998 Adams et al.
5,848,932 A 12/1998 Adams et al.
5,855,515 A 1/1999 Pease et al.
5,873,781 A 2/1999 Keane et al.
5,882,261 A 3/1999 Adams et al.
5,885,157 A 3/1999 Harada et al.
5,885,158 A 3/1999 Torango et al.
5,911,418 A 6/1999 Adams et al.
5,919,088 A 7/1999 Weiss et al.
5,947,820 A 9/1999 Morro et al.
5,964,463 A 10/1999 Moore et al.
5,980,384 A 11/1999 Barrie
5,997,401 A 12/1999 Crawford
6,004,207 A 12/1999 Wilson et al.
6,015,346 A 1/2000 Bennett
6,033,307 A 3/2000 Vancura et al.
6,059,289 A 5/2000 Vancura et al.
6,059,658 A 5/2000 Mangano et al.
6,062,980 A 5/2000 Luciano
6,089,976 A 7/2000 Schneider et al.
6,089,978 A 7/2000 Adams
6,093,102 A 7/2000 Bennett et al.
6,102,798 A 8/2000 Bennett
6,110,043 A 8/2000 Olsen
6,113,098 A 9/2000 Adams et al.
6,120,031 A 9/2000 Adams et al.
6,120,377 A 9/2000 McGinnis et al.
6,126,542 A 10/2000 Fier
6,135,884 A 10/2000 Hedrick et al.
6,142,873 A 11/2000 Weiss et al.
6,146,273 A 11/2000 Olsen et al.
6,159,095 A 12/2000 Frohm et al.
6,159,097 A 12/2000 Gura et al.
6,159,098 A 12/2000 Slomiany et al.
6,162,121 A 12/2000 Morro et al.
6,168,520 B1 1/2001 Baerlocher et al.
6,168,523 B1 1/2001 Piechowiak et al.
6,173,955 B1 1/2001 Perrie et al.
6,174,235 B1 1/2001 Walker et al.
6,186,894 B1 2/2001 Mayeroff
6,190,254 B1 2/2001 Bennett
6,190,255 B1 2/2001 Thomas et al.
6,200,217 B1 3/2001 Osawa
6,203,010 B1 3/2001 Jorasch et al.
6,203,429 B1 3/2001 Demar et al.
6,210,275 B1 4/2001 Olsen
6,213,876 B1 4/2001 Moore, Jr.
6,224,483 B1 5/2001 Mayeroff
6,227,971 B1 5/2001 Weiss
6,227,972 B1 5/2001 Walker et al.
6,231,442 B1 5/2001 Mayeroff
6,234,897 B1 5/2001 Frohm et al.
6,261,177 B1 7/2001 Bennett
6,270,411 B1 8/2001 Gura et al.
6,283,855 B1 9/2001 Bingham
6,302,790 B1 10/2001 Brossard
6,305,686 B1 10/2001 Perrie et al.
6,309,300 B1 10/2001 Glavich
6,312,334 B1 11/2001 Yoseloff
6,315,664 B1 11/2001 Baerlocher et al.
6,319,123 B1 11/2001 Paludi
6,328,649 B1 12/2001 Randall et al.
6,334,814 B1 1/2002 Adams
6,336,860 B1 1/2002 Webb
6,336,863 B1 1/2002 Baerlocher et al.
6,338,678 B1 1/2002 Seelig et al.
6,346,043 B1 2/2002 Colin et al.
6,347,795 B1 2/2002 De Leljer
6,347,996 B1 2/2002 Gilmore et al.
6,364,766 B1 4/2002 Anderson et al.
6,364,767 B1 4/2002 Brossard et al.
6,375,187 B1 4/2002 Baerlocher
6,398,218 B1 6/2002 Vancura
6,398,644 B1 6/2002 Perrie et al.
6,406,369 B1 6/2002 Baerlocher et al.
6,413,160 B1 7/2002 Vancura
6,419,579 B1 7/2002 Bennett
6,428,412 B1 8/2002 Anderson et al.
6,435,511 B1 8/2002 Vancura et al.
6,439,995 B1 8/2002 Hughs-Baird et al.
6,443,837 B1 9/2002 Jaffe et al.
6,450,884 B1 9/2002 Seelig et al.
6,454,651 B1 9/2002 Yoseloff
6,464,582 B1 10/2002 Baerlocher et al.
6,481,713 B2 11/2002 Perrie et al.
6,482,089 B2 11/2002 DeMar et al.
6,491,584 B2 12/2002 Graham et al.
6,494,654 B2 12/2002 Espinosa
6,506,117 B2 1/2003 DeMar et al.
6,508,707 B2 1/2003 DeMar et al.
6,561,512 B2 5/2003 Luciano et al.
6,561,904 B2 5/2003 Locke et al.
6,569,015 B1 5/2003 Baerlocher et al.
6,582,306 B1 6/2003 Kaminkow
6,582,307 B2 6/2003 Webb
6,599,185 B1 7/2003 Kaminkow et al.
6,599,193 B2 7/2003 Baerlocher et al.
6,602,135 B1 8/2003 Gerrard
6,602,137 B2 8/2003 Kaminkow et al.
6,605,000 B2 8/2003 Adams
6,607,437 B2 8/2003 Casey et al.
6,663,489 B2 12/2003 Baerlocher
6,705,944 B2 3/2004 Luciano
6,729,955 B2 5/2004 Bennett et al.
6,749,502 B2 6/2004 Baerlocher
6,769,987 B1 8/2004 Morita et al.
6,786,819 B2 9/2004 Baerlocher et al.
6,793,577 B1 9/2004 Wilkins et al.
6,827,646 B2 12/2004 Adams
6,835,132 B2 12/2004 Bennett
6,855,052 B2 * 2/2005 Weiss ..... G07F 17/32 273/143 R
D503,951 S 4/2005 Karstens
6,890,255 B2 5/2005 Jarvis et al.
6,899,620 B2 5/2005 Kaminkow et al.
6,905,405 B2 6/2005 McClintic
6,905,407 B2 6/2005 Nordman
7,029,395 B1 * 4/2006 Baerlocher ..... G07F 17/3258 463/16
7,040,983 B2 5/2006 Dolloff et al.
7,056,209 B2 6/2006 Baerlocher et al.
7,059,967 B2 6/2006 Baerlocher
7,066,814 B2 6/2006 Glavich et al.
7,070,505 B2 7/2006 Vancura et al.
7,121,943 B2 10/2006 Webb et al.
7,128,646 B2 10/2006 Baerlocher et al.
7,144,321 B2 12/2006 Mayeroff
7,160,188 B2 1/2007 Kaminkow et al.
7,179,169 B2 2/2007 Beaulieu et al.
7,198,570 B2 4/2007 Rodgers et al.
7,226,358 B2 6/2007 Miller et al.
7,235,011 B2 6/2007 Randall et al.
7,294,055 B2 11/2007 Baerlocher et al.
7,297,059 B2 11/2007 Vancura et al.
7,306,520 B2 12/2007 Kaminkow et al.
7,311,598 B2 12/2007 Kaminkow et al.
7,311,604 B2 12/2007 Kaminkow et al.
7,341,512 B2 3/2008 Dolloff et al.
7,354,342 B2 4/2008 Paulsen et al.

(56) References Cited

U.S. PATENT DOCUMENTS 7,357,716 B2 4/2008 Marks et al.
7,361,088 B2 4/2008 Maya et al.
7,399,226 B2 * 7/2008 Mishra ..... G07F 17/3244 273/139
7,425,177 B2 9/2008 Rodgers et al.
7,427,236 B2 9/2008 Kaminkow et al.
7,431,649 B2 10/2008 Webb et al.
7,442,123 B2 10/2008 Brill et al.
7,455,585 B2 11/2008 Englman
7,470,184 B2 12/2008 Baerlocher et al.
7,568,973 B2 8/2009 Iddings et al.
7,575,514 B2 8/2009 Cuddy et al.
7,585,223 B2 9/2009 Iddings et al.
7,591,723 B2 9/2009 Cregan et al.
7,597,618 B2 * 10/2009 Webb ..... G07F 17/32 273/138.1
7,597,621 B2 10/2009 Baerlocher
7,614,947 B2 11/2009 Baerlocher et al.
7,651,392 B2 1/2010 Pennington et al.
7,666,093 B2 2/2010 Lafky et al.
7,674,172 B2 3/2010 Miltenberger et al.
7,682,248 B2 3/2010 Baerlocher et al.
7,708,628 B2 5/2010 Baerlocher
7,708,630 B2 5/2010 Nicely
7,713,120 B2 5/2010 Cannon
7,722,462 B2 5/2010 Mayeroff
7,740,535 B2 6/2010 Kido
7,771,268 B2 8/2010 Mayeroff
7,780,520 B2 8/2010 Baerlocher
7,780,523 B2 8/2010 Baerlocher et al.
7,794,317 B2 9/2010 Kaminkow et al.
7,806,760 B2 10/2010 Baerlocher
7,841,936 B2 * 11/2010 Berman ..... G07F 17/3211 463/20
7,841,939 B2 11/2010 Baerlocher et al.
7,850,171 B2 12/2010 Bontempo et al.
7,914,377 B2 3/2011 Benbrahim et al.
7,942,737 B2 5/2011 Cregan et al.
7,963,845 B2 6/2011 Baerlocher
8,033,903 B2 10/2011 Cregan
8,070,597 B2 12/2011 Cuddy
8,092,293 B2 1/2012 Richards et al.
8,092,302 B2 1/2012 Cuddy et al.
8,096,874 B2 1/2012 Nicely et al.
8,100,754 B2 1/2012 Bigelow, Jr. et al.
8,113,939 B2 2/2012 Cannon
8,128,491 B2 3/2012 Vasquez et al.
8,137,188 B2 3/2012 Breckner et al.
8,152,171 B2 4/2012 Miltenberger et al.
8,157,646 B2 4/2012 Pawloski et al.
8,197,337 B2 6/2012 DeWaal et al.
8,210,944 B2 7/2012 Mead
8,221,214 B2 7/2012 Nicely
8,231,453 B2 7/2012 Wolf et al.
8,262,458 B2 9/2012 Rodgers et al.
8,308,547 B2 11/2012 Walker et al.
8,435,111 B2 5/2013 Filipour et al.
8,454,434 B1 6/2013 Schaefer et al.
8,500,548 B2 8/2013 Baerlocher et al.
8,956,213 B2 * 2/2015 Manz ..... A63F 9/24 463/16
9,311,787 B2 * 4/2016 Meyer ..... G07F 17/3211
2001/0049298 A1 12/2001 Bennett
2002/0004424 A1 1/2002 Nelson et al.
2002/0025846 A1 2/2002 Bennett et al.
2002/0025849 A1 2/2002 Olive
2002/0042294 A1 4/2002 Pau et al.
2003/0027628 A1 2/2003 Luciano
2003/0040355 A1 2/2003 Baerlocher
2003/0064790 A1 4/2003 Hughs-Baird et al.
2003/0078089 A1 4/2003 Gray et al.
2003/0178768 A1 9/2003 Luciano et al.
2003/0181239 A1 9/2003 Walker et al.
2004/0000754 A1 1/2004 Inoue
2004/0002372 A1 1/2004 Rodgers et al.
2004/0014517 A1 1/2004 Inoue
2004/0017041 A1 1/2004 Inoue
2004/0053665 A1 3/2004 Baerlocher
2004/0077403 A1 4/2004 Maya et al.
2004/0150161 A1 8/2004 Inoue
2004/0171419 A1 9/2004 Walker et al.
2005/0014562 A1 1/2005 Fujimoto
2005/0054412 A1 3/2005 Gauselmann
2005/0059455 A1 3/2005 Gerrard et al.
2005/0070353 A1 * 3/2005 Webb ..... G07F 17/32 463/16
2006/0025200 A1 2/2006 Van Asdale
2006/0183535 A1 8/2006 Marks et al.
2006/0189364 A1 8/2006 Baerlocher
2006/0237905 A1 10/2006 Nicely et al.
2007/0129131 A1 6/2007 Kaminkow et al.
2008/0026824 A1 * 1/2008 Muir ..... G07F 17/32 463/25
2008/0090651 A1 4/2008 Baerlocher
2008/0108430 A1 5/2008 Evans
2008/0108431 A1 5/2008 Cuddy et al.
2009/0042645 A1 2/2009 Graham et al.
2009/0124362 A1 5/2009 Cuddy et al.
2009/0124364 A1 5/2009 Cuddy et al.
2011/0003637 A1 1/2011 LeFever
2011/0111843 A1 5/2011 Nicely et al.
2012/0129588 A1 5/2012 Cannon
2013/0059638 A1 3/2013 Nicely
2013/0059647 A1 3/2013 Nicely
2013/0203486 A1 8/2013 Baerlocher et al.
2013/0225277 A1 8/2013 Hughes

FOREIGN PATENT DOCUMENTS

DE 19600787 5/1997
DE 19613455 8/1997
DE 19926280 3/2000
DE 19936196 1/2001
EP 0797175 9/1997
GB 2100905 6/1981
GB 2106293 9/1981
GB 2090690 7/1982
GB 2096376 10/1982
GB 2137392 10/1984
GB 2144644 3/1985
GB 2153572 8/1985
GB 2170636 8/1986
GB 2180682 4/1987
GB 2181589 4/1987
GB 2183882 6/1987
GB 2191030 12/1987
GB 2201821 9/1988
GB 2222712 3/1990
GB 2225889 6/1990
GB 2242300 9/1991
GB 2322217 8/1998
WO WO 03/011409 2/2003

* cited by examiner

WHEEL 1
WHEEL 2
WHEEL 3
200
201
202
203
204
205
206
207
208
209
210
211
212
213
214
215
216
217
218
219
220
221
222
223
224
JP1
W2
100
160
240
300
500
200
400
300
JP2
W3
200
400
700
300
JP3
1000
600
300
500
400
400
500
600
1000
300
600
1000
400
500
300
600
1000
400
500
300
600
1000
400
500

GAMING SYSTEM AND METHOD PROVIDING GAME WITH MULTIPLE AWARD DISPLAYS

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Generally, symbols or symbol combinations which are less likely to occur usually provide higher awards. In such known gaming machines, the amount of the wager made on the base game by the player may vary.

Gaming machines which provide secondary or bonus games are also known. The secondary or bonus games usually provide an additional award, such as a bonus award, to the player. Secondary or bonus games usually do not require an additional wager by the player to be activated. Instead, secondary or bonus games are generally activated or triggered upon an occurrence of a designated triggering symbol or triggering symbol combination in the primary or base game. For instance, a bonus symbol occurring on the payline on the third reel of a three reel slot machine may trigger the secondary bonus game. When a secondary or bonus game is triggered, the gaming machine generally indicates this triggering to the player through one or more visual and/or audio output devices, such as the reels, lights, speakers, video screens, etc. Part of the enjoyment and excitement of playing certain gaming machines is the occurrence or triggering of the secondary or bonus game (even before the player knows how much the bonus award will be).

Another known game feature that can add to player excitement is the potential to win large awards. Certain slot machine games in certain jurisdictions offer a wheel bonus game with at least one section of the wheel offering an exceptional award (such as a 1000× prize, a jackpot prize, or an entry into another bonus game). These bonus games typically rely upon a weighted wheel mechanism such that the odds of a given section of the wheel being selected for the outcome is not proportional to circular width of the section. Were equal sized sections equally likely to be selected in such bonus games, the overall expected bonus award value would be too high for the desired bonus frequency.

In certain jurisdictions, whether due to regulation and/or due to market expectations, bonus wheels may not be weighted. In other words, the odds of any given section being indicated must be exactly proportional to the section's circular width. Such restrictions prevent the use of especially large wheel sections while maintaining a desirable bonus frequency. Therefore, there is a need to be able to provide higher-value awards in such a wheel-based bonus without the use of outcome weighting. In other words, there is a need to be able to provide one or more win events at a win frequency significantly lower than the least likely outcome of a single spin of an un-weighted wheel.

There also exist various games that award a non-standard prize such as an ever-increasing progressive jackpot award or a physical prize such as a car. Certain of these games with progressive jackpots offer two or more jackpot awards that a player can be eligible to win on a given play of the game, often referred to in the industry as multi-level progressive game. In certain multi-level progressive games, the chance of winning at a given level varies relative to level, typically such that the higher the average jackpot award value, the harder it is to win that level. In certain implementations, these diminishing probabilities follow a strict geometric sequence, such as a 1/1000 chance to win the jackpot level with the lowest average jackpot award, a 1/2000 chance to win the jackpot level with the second lowest average jackpot award, and a 1/4000 chance to win the jackpot level with the highest average jackpot award for a three-level multi-level progressive award configuration. In certain implementations, each eligible jackpot level is equi-probable of being won.

There also exist various games with more than one bonus wheel which can be activated in a given bonus game. These typically are offered in two forms: (1) the player earns the sum of the values from the spin of each of the bonus wheels; and (2) the player earns the sum of the values from the spin of each award bonus wheel multiplied by the sum of the values of the spins of each multiplier bonus wheel. There is a need to leverage the popular mechanism available via a bonus game with two or more bonus wheels while maintaining strict control of the relative odds of two or more designated prizes, especially when the weighting of wheel outcomes is not allowed by the specific jurisdiction.

Additionally, since gaming machines with award displays such as bonus wheels are very popular with many players, there is a continuing need to provide new award displays and configurations such as new and different bonus wheel configurations.

SUMMARY

In various embodiments, the gaming system and method disclosed herein provides a game with multiple individually and independently activated un-weighted award displays (such as wheels), wherein a plurality of designated awards with equal sectional sizes (such as circular widths) have the same probability of being won regardless of how many of said award displays are activated. Generally, for wheels, this means that the probability of a given award being won is directly proportional to the circular width of the award section for that award. In certain other embodiments, the gaming system and method disclosed herein provides a game with multiple individually and independently activated un-weighted award displays, wherein a plurality of designated awards have the same probability of being won regardless of how many of said award displays are activated and regardless of the order of activation of the award displays. In various embodiments, the plurality of designated awards are the same award, and in other embodiments, two or more of the designated awards are different. In various embodiments, one or more of the designated awards are credit values, and in other embodiments, one or more of the designated awards are progressive awards. In various embodiments, the un-weighted award displays include a plurality of award wheels such as three award wheels.

In the various embodiments, the gaming system and method disclosed herein provides a game with multiple individually and independently activated un-weighted award displays, where a first award display is activated after a designated triggering event. The activation of the first award display can result in one of a plurality of different standard awards being provided to the player, a designated award (such as a jackpot award) being provided to the player, or a transfer or advancement to another award display. If the transfer or advancement to the other award display occurs, then that award display is activated. This process continues until the player obtains a standard award or a designated award.

In various embodiments of the present disclosure, only one award is won from activation of the plurality of award displays. In other embodiments as described below, multiple awards can be won from activation of the plurality of award displays. In the embodiments where only one award can be won, the structure of the gaming system of the present disclosure enables the display of relatively large awards on the award displays while maintaining a particular threshold on the expected value for the overall bonus. In certain embodiments where only one award can be won, the probability of winning specific award from different un-weighted wheels is made exactly equal. In other embodiments where only one award can be won, the probability of winning specific award from different un-weighted wheels are made to follow an exact mathematical sequence such as a geometric series or an arithmetic sequence.

In various embodiments, the gaming system and method of the present disclosure provide a game with un-weighted award displays which provide an average player with an intuitive understanding of the odds of achieving each of the outcomes of each activation of each of the award displays and thus each of the awards.

Additional features and advantages are described in, and will be apparent from, the following Detailed Description and the figures.

DETAILED DESCRIPTION

Multiple Award Displays

In various embodiments, the gaming system and method disclosed herein provides a game with multiple individually and independently activated un-weighted award displays, wherein a plurality of designated awards have the same probability of being won regardless of how many of the award displays are activated. In other embodiments, the gaming system and method disclosed herein provides a game with multiple individually and independently activated un-weighted award displays, wherein a plurality of designated awards have the same probability of being won regardless of how many of the award displays are activated and regardless of the order of activation of the award displays. In other embodiments, the gaming system and method disclosed herein provides a game with multiple individually and independently activated un-weighted award displays, wherein a plurality of designated awards have a decreasing probability of being won. In certain variations, the decreasing probabilities follow an exact mathematical series such as an exponentially diminishing geometric series. In other embodiments, the gaming system and method disclosed herein includes a game with multiple individually and independently activated un-weighted award displays, wherein a plurality of designated awards have an increasing probability of being won. In certain variations, the increasing probabilities follow an exact mathematical series such as a exponentially growing geometric series.

In the various embodiments, the gaming system and method disclosed herein provides a game with multiple individually and independently activated un-weighted award displays, where a first award display is activated after a designated triggering event. The activation of the first award display can result in a standard award being provided to the player, a designated award (such as a jackpot award) being provided to the player, or a transfer or advancement to another one of the award displays. If the transfer or advancement to another award display occurs, then that award display is activated. This process continues until the player obtains a standard award or a designated award as further explained below.

While the embodiments described below are directed to a secondary or bonus game, it should be appreciated that the present disclosure may additionally or alternatively be employed in association with a primary or base game. Moreover, while the player's credit balance, the player's wager, and any awards are displayed as an amount of monetary credits or currency in certain of the embodiments described below, one or more of such player's credit balance, such player's wager, and any awards provided to such a player may be for non-monetary credits, promotional credits, and/or player tracking points or credits.

Example Embodiment 1

Figure 1:
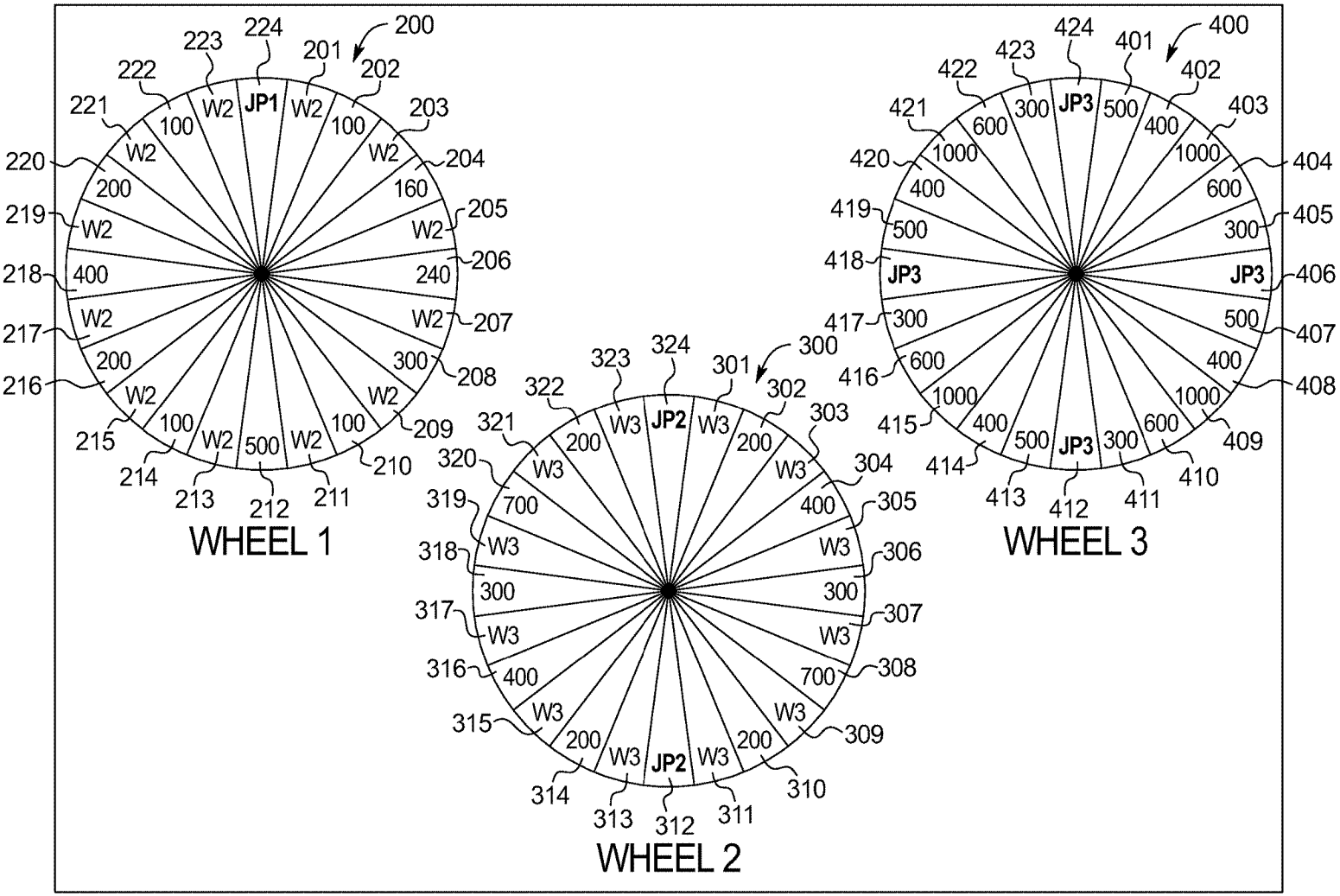
FIG. 1 is a front view of a display device displaying three award display wheels of a multiple award display game of one embodiment of the present disclosure.

Referring now to the drawings and specifically to FIG. 1, the multiple un-weighted award displays of a bonus game of one embodiment of the gaming system of the present disclosure is generally illustrated. This embodiment includes three award displays which are in the form of three wheels 200, 300, and 400 (respectively labeled WHEEL 1, WHEEL 2, and WHEEL 3). It should be appreciated that one or more of the award displays can be in other suitable forms in accordance with the present disclosure. These wheels, the number of sections on these wheels, the probabilities of indicating each of the sections on each of these wheels, the transfers on the wheels to the other wheels, and the awards on these wheels are configured such that the designated awards (such as the jackpot awards represented by symbols JP1, JP2, and JP3) have a same probability of being won regardless of how many of the wheels are activated.

More specifically, in this example embodiment, award display or wheel 200 includes 24 sections or 201, 202, 203, 204, 205, 206, 207, 208, 209, 210, 211, 212, 213, 214, 215, 216, 217, 218, 219, 220, 221, 222, 223, and 224. Wheel 200 includes: (a) one designated award symbol and particularly one jackpot award symbol (designated JP1) on section 224; (b) award 100 on section 202; (c) award 160 on section 204; (d) award 240 on section 206; (e) award 300 on section 208; (f) award 100 on section 210; (g) award 500 on section 212; (h) award 100 on section 214; (i) award 200 on section 216; (j) award 400 on section 218; (k) award 200 on section 220; and (l) award 100 on section 222. Wheel 200 further includes transfers to wheel 300 (each designated W2) on each of sections 201, 203, 205, 207, 209, 211, 213, 215, 217, 219, 221, and 223. In this embodiment, each section of wheel 200 has the same circular width (i.e., $1/24^{th}$ of a full circle) and has an equal chance or probability (i.e., a 1 in 24 chance or probability) of being indicated by a spin or activation of the wheel 200. This wheel 200 is thus considered to be un-weighted. Thus, wheel 200 provides: (a) a 1/24 chance or probability of obtaining the designated award or jackpot award JP1; (b) a 11/24 chance of obtaining one of the other awards on wheel 200; and (c) a 12/24 (or 1/2) chance of obtaining a transfer to wheel 300. It should be appreciated that a transfer to another wheel causes an activation of that other wheel. The activation of the other wheel can be automatic or player initiated.

In this example embodiment, award display or wheel 300 includes 24 sections 301, 302, 303, 304, 305, 306, 307, 308, 309, 310, 311, 312, 313, 314, 315, 316, 317, 318, 319, 320, 321, 322, 323, and 324. Wheel 300 includes: (a) two designated award symbols and particularly two jackpot award symbols (each designated JP2) on sections 312 and 324; (b) award 200 on section 302; (c) award 400 on section 304; (d) award 300 on section 306; (e) award 700 on section 308; (f) award 200 on section 310; (g) award 200 on section 314; (h) award 400 on section 316; (i) award 300 on section 318; (j) award 700 on section 320; and (k) award 200 on section 322. Wheel 300 further includes transfers to wheel 400 (each designated W3) on each of sections 301, 303, 305, 307, 309, 311, 313, 315, 317, 319, 321, and 323. Each section of wheel 300 has the same circular width (i.e., $1/24^{th}$ of a full circle) and has an equal chance or probability (i.e., a 1 in 24 chance or probability) of being indicated by a spin or activation of the wheel 300. This wheel 300 is thus considered to be un-weighted. Thus, wheel 300 provides: (a) a 2/24 (or 1/12) chance or probability of obtaining the designated award or jackpot award JP2; (b) a 10/24 (or 5/12) chance of obtaining one of the other awards on wheel 300; and (c) a 12/24 (or 1/12) chance of obtaining a transfer to wheel 400.

In this example embodiment, award display or wheel 400 includes 24 sections 401, 402, 403, 404, 405, 406, 407, 408, 409, 410, 411, 412, 413, 414, 415, 416, 417, 418, 419, 420, 421, 422, 423, and 424. Wheel 400 includes: (a) four designated award symbols and particularly four jackpot award symbols (designated JP3) on sections 406, 412, 418, and 424; (b) award 500 on section 401; (c) award 400 on section 402; (d) award 1000 on section 403; (e) award 600 on section 404; (f) award 300 on section 405; (g) award 500 on section 407; (h) award 400 on section 408; (i) award 1000 on section 409; (j) award 600 on section 410; (k) award 300 on section 411; (l) award 500 on section 413; (m) award 400 on section 414; (n) award 1000 on section 415; (o) award 600 on section 416; (p) award 300 on section 417; (q) award 500 on section 419; (r) award 400 on section 420; (s) award 1000 on section 421; (t) award 600 on section 422; and (u) award 300 on section 423. In this example, wheel 400 does not include any transfers to the wheel 200 or the wheel 300. Each section of wheel 400 has the same circular width (i.e., $1/24^{th}$ of a full circle) and has an equal chance or probability (i.e., a 1 in 24 chance or probability) of being indicated by a spin or activation of the wheel 400. This wheel 400 is thus considered to be un-weighted. Thus, wheel 400 provides: (a) a 4/24 (or 1/6) chance or probability of obtaining the designated award or jackpot award JP3; and (b) a 20/24 (or 5/6) chance or probability of obtaining one of the other awards on wheel 400.

From the above, it should be appreciated that each of the designated awards or jackpot awards (associated the JP1, JP2, and JP3 symbols) is equally likely to be provided to the player regardless of how many of the wheels are activated. More specifically, this configuration of wheels, awards, transfers, and probabilities provides the player with: (a) a 1/24 chance or probability of obtaining the JP1 symbol from the spin of the wheel 200; (b) a 1/24 chance or probability of obtaining one of the JP2 symbols from the spins of the wheels 200 and 300 (i.e., (1/2 chance or probability of getting a transfer on wheel 200 to wheel 300)×(2/24 chance of getting the JP2 symbol on wheel 300)=2/48=1/24); and (c) 1/24 chance or probability of obtaining one of the JP3 symbols from the spins of the wheels 200, 300, and 400 (i.e., ((1/2 chance or probability of getting a transfer on wheel 200 to wheel 300)×(1/2 chance or probability of getting a transfer on wheel 300 to wheel 400)×(4/24 chance of getting the JP3 symbol on wheel 400))=4/96=1/24).

In this example, (a) if only wheel 200 is activated, then the player has a 1/24 chance or probability of winning the designated award JP1; (b) if only wheel 200 and wheel 300 are activated, then the player has a 1/24 chance or probability of winning one of the designated awards JP1 or JP2; and (c) if wheel 200, wheel 300, and wheel 400 are all activated, then the player has a 1/24 chance or probability of winning one of the designated awards JP1, JP2 or JP3. Thus, regardless of the number of wheels activated, the chance or probability of winning one of the designated awards is the same for the player.

In an alternative embodiment not shown in the drawings, a set of award displays similar to those in FIG. 1 provide geometrically increasing jackpot win probabilities with the following modifications: (a) for wheel 200, no change; (b) for wheel 300, the number of JP2 designators is doubled with sections 306 and 318 each designated as JP2 winners; and (c) for wheel 400, the number of JP3 designators is quadrupled with sections 402, 404, 408, 410, 414, 416, 420, and 422 designated as JP3 winners. As mentioned above, the jackpot win probabilities for the example of FIG. 1 are 1/24, 1/24 and 1/24 for jackpots JP1, JP2 and JP3, respectively. For this modified example of this paragraph, the JP2 win probability is doubled and the JP3 win probability is quadrupled, and therefore the jackpot win probabilities are 1/24, 2/24 and 4/24 for JP1, JP2, and JP3, respectively, which is an exact geometric series.

In another alternative embodiment not shown in the drawings, a set of award displays similar to those in FIG. 1 provide an arithmetically increasing jackpot win probabilities with the following modifications: (a) for wheel 200, no change; (b) for wheel 300, the number of JP2 designators is doubled with sections 306 and 318 each designated as JP2 winners; and (c) for wheel 400, the number of JP3 designators is tripled with sections 403, 408, 410, 415, 420, and 422 designated as JP3 winners. As mentioned above, the jackpot win probabilities for the example of FIG. 1 are 1/24, 1/24 and 1/24 for jackpots JP1, JP2, and JP3, respectively. For this modified example of this paragraph, the JP2 win probability is doubled and the JP3 win probability is tripled, and therefore the jackpot win probabilities are 1/24, 2/24, and 3/24 for JP1, JP2, and JP3, respectively, which is an exact arithmetic series.

Turing back to FIG. 1, in one embodiment, the amount of each designated award JP1, JP2, and JP3 is the same for each of the wheels 200, 300, and 400. In this embodiment, the designated award has the same chance of occurring if one wheel is activated, two wheels are activated, or if all three of the wheels are activated. In other embodiments, two or more of the designated awards JP1, JP2, and JP3 are of different amounts. In one such embodiment, the JP3 award is greater than the JP2 award, and the JP2 award is greater than the JP1 award. In various embodiments, one or more of the designated awards JP1, JP2, and JP3 are progressive awards. In various embodiments, the designated awards JP1, JP2, and JP3 are multi-level progressive awards.

In the illustrated example embodiment of FIG. 1, once an award or designated award is won by the player, the bonus game ends and the other wheels are not activated.

In the illustrated example embodiment of FIG. 1, the quantity of designated awards is geometrically or exponentially increased for each successive award wheel (i.e., from 1 for wheel 200, to 2 for wheel 300, to 4 for wheel 400). However, it should be appreciated that in other embodiments of the present disclosure these ratios may vary.

In the illustrated example embodiment of FIG. 1, the game is a bonus game which is triggered during, from, or as a result of the play of a primary wagering game by a player. It should also be appreciated that any suitable bonus trigging event can be employed with this example bonus game embodiment.

Example Embodiment 2

Figure 2:
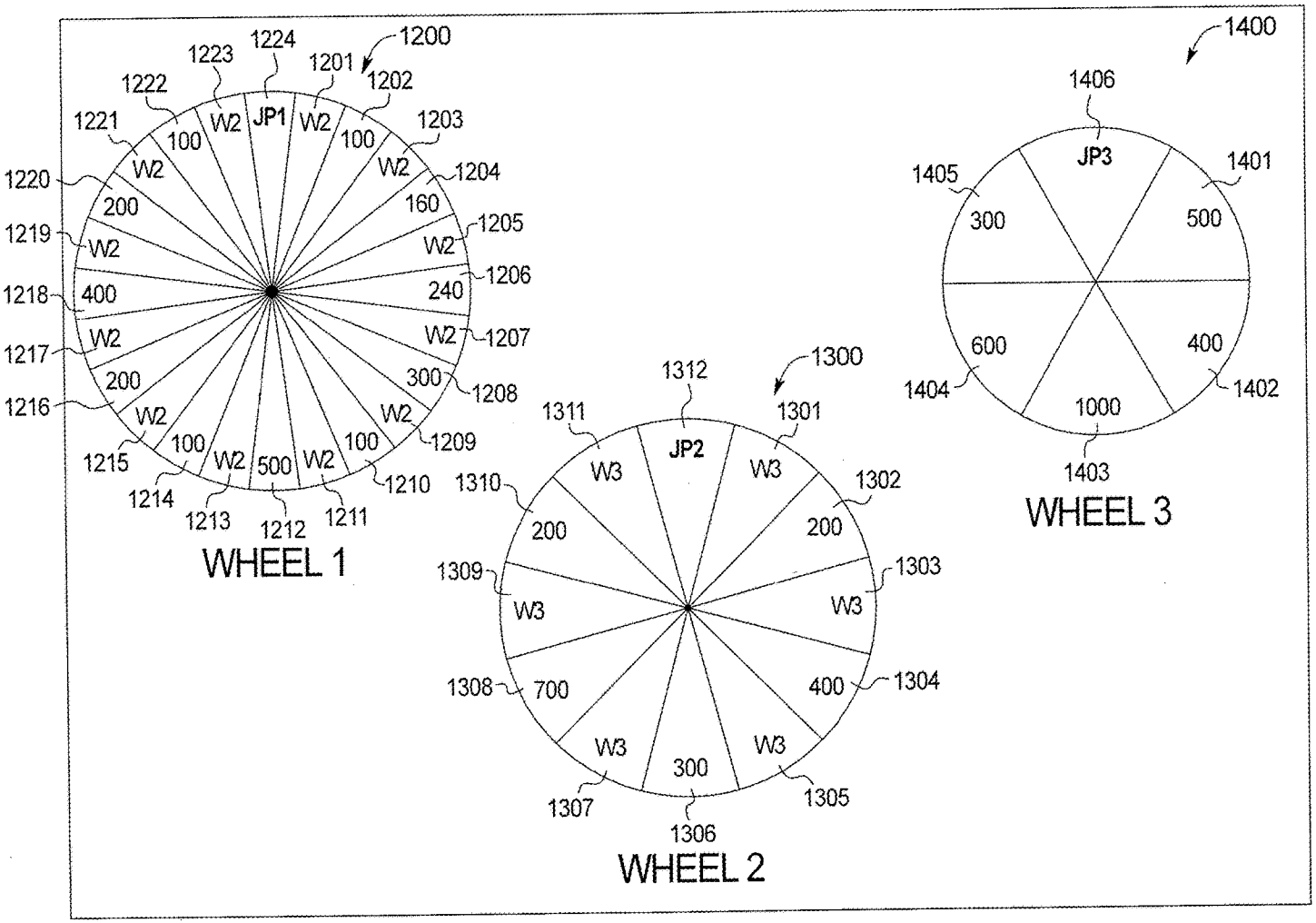
FIG. 2 is a front view of a display device displaying three award display wheels of a multiple award display game of another embodiment of the present disclosure.

In the above illustrated example embodiment, each of the award displays 200, 300, and 400 has an equal quantity of sections. However, it should be appreciated that in other embodiments, two or more of the un-weighted award displays have an unequal quantity of sections to achieve the same likelihood of obtaining the one or more designated awards. For example, FIG. 2 illustrates another example embodiment of the present disclosure which includes three award displays which are in the form of three wheels 1200, 1300, and 1400 (respectively labeled WHEEL 1, WHEEL 2, and WHEEL 3). Wheel 1200 has twice as many sections as wheel 1300, and wheel 1300 has twice as many sections as wheel 1300.

More specifically, in this example embodiment, award display or wheel 1200 includes 24 sections 1201, 1202, 1203, 1204, 1205, 1206, 1207, 1208, 1209, 1210, 1211, 1212, 1213, 1214, 1215, 1216, 1217, 1218, 1219, 1220, 1221, 1222, 1223, and 1224. Wheel 1200 includes: (a) one designated award symbol and particularly one jackpot award symbol (designated JP1) on section 1224; (b) award 100 on section 1202; (c) award 160 on section 1204; (d) award 240 on section 1206; (e) award 300 on section 1208; (f) award 100 on section 1210; (g) award 500 on section 1212; (h) award 100 on section 1214; (i) award 200 on section 1216; (j) award 400 on section 1218; (k) award 200 on section 1220; and (l) award 100 on section 1222. Wheel 1200 further includes transfers to wheel 1300 (each designated W2) on each of sections 1201, 1203, 1205, 1207, 1209, 1211, 1213, 1215, 1217, 1219, 1221, and 1223. Each section of wheel 1200 has the same circular width (i.e., $1/24^{th}$ of a full circle) and has an equal chance or probability (i.e., a 1 in 24 chance or probability) of being indicated by a spin or activation of the wheel 1200. This wheel 1200 is thus considered to be un-weighted. Thus, wheel 1200 provides: (a) a 1/24 chance or probability of obtaining the designated award or jackpot award JP1; (b) a 11/24 chance of obtaining one of the other awards on wheel 1200; and (c) a 12/24 (or 1/2) chance of obtaining a transfer to wheel 1300.

In this example embodiment, award display or wheel 1300 includes 12 sections 1301, 1302, 1303, 1304, 1305, 1306, 1307, 1308, 1309, 1310, 1311, and 1312. Wheel 1300 includes: (a) a designated award symbol and particularly one jackpot award symbol (designated JP2) on section 1312; (b) award 200 on section 1302; (c) award 400 on section 1304; (d) award 300 on section 1306; (e) award 700 on section 1308; and (f) award 200 on section 1310. Wheel 1300 further includes transfers to wheel 1400 (each designated W3) on each of sections 1301, 1303, 1305, 1307, 1309, and 1311. Each section of wheel 1300 has the same circular width (i.e., $1/12^{th}$ of a full circle) and has an equal chance or probability (i.e., a 1 in 12 chance or probability) of being indicated by a spin or activation of the wheel 1300. This wheel 1300 is thus considered to be un-weighted. Thus, wheel 1300 provides: (a) a 1/12 chance or probability of obtaining the designated award or jackpot award JP2; (b) a 5/12 chance or probability of obtaining one of the other awards on wheel 1300; and (c) a 6/12 (or 1/2) chance or probability of obtaining a transfer to wheel 1400.

In this example embodiment, award display or wheel 1400 includes 6 sections 1401, 1402, 1403, 1404, 1405, and 1406. Wheel 1400 includes: (a) one designated award symbol and particularly one jackpot award symbol (designated JP3) on section 1406; (b) award 500 on section 1401; (c) award 400 on section 1402; (d) award 1000 on section 1403; (e) award 600 on section 1404; and (f) award 300 on section 1405. In this example, wheel 1400 does not include any transfers to the wheel 1200 or the wheel 1300. Each section of wheel 1400 has the same circular width (i.e., $1/6^{th}$ of a full circle) and has an equal chance or probability (i.e., a 1 in 6 chance or probability) of being indicated by a spin or activation of the wheel 1400. This wheel 1400 is thus considered to be un-weighted. Thus, wheel 1400 provides: (a) a 1/6 chance or probability of obtaining the designated award or jackpot award JP3; and (b) a 5/6 chance or probability of obtaining one of the other awards on wheel 1400.

From the above, it should be appreciated that each of the designated awards or jackpot awards (associated with the JP1, JP2, and JP3 symbols) is equally likely to be provided to the player regardless of whether only wheel 1200 is activated, only wheels 1200 and 1300 are activated, or if wheels 1200, 1300, and 1400 are activated.

More specifically, this configuration of wheels, awards, transfers, and probabilities provides the player with: (a) a 1/24 chance or probability of obtaining the JP1 symbol from the spin of the wheel 1200; (b) a 1/24 chance or probability of obtaining the JP2 symbol from the spins of the wheels

1200 and 1300 (i.e., (1/2 chance or probability of getting a transfer on wheel 1200 to wheel 1300)×(1/12 chance of getting the JP2 on wheel 1300)=1/24); and (c) 1/24 chance or probability of obtaining the JP3 symbol from the spins of the wheels 1200, 1300, and 1400 (i.e., (1/2 chance or probability of getting a transfer on wheel 1200 to wheel 1300)×(1/2 chance or probability of getting a transfer on wheel 1300 to wheel 1400)×(1/6 chance of getting the JP3 on wheel 400)=1/24).

In one embodiment, the amount of each designated award JP1, JP2, and JP3 is the same for each of the wheels 1200, 1300, and 1400. In this embodiment, the designated award has the same chance of occurring if one wheel is activated, two wheels are activated, or if all three of the wheels are activated. In other embodiments, two or more of the designated awards JP1, JP2, and JP3 are of different amounts. In one such embodiment, the JP3 award is greater than the JP2 award, and the JP2 award is greater than the JP1 award. In various embodiments, one or more of the designated awards JP1, JP2, and JP3 are progressive awards. In various embodiments, the designated awards JP1, JP2, and JP3 are multi-level progressive awards.

In the illustrated example embodiment of FIG. 2, once an award or designated award is won by the player, the bonus game ends and the other wheels are not activated.

In the illustrated example embodiment of FIG. 2, the quantity of designated awards remains the same for each successive award wheel (i.e., 1 for wheel 1200, 1 for wheel 1300, and 1 for wheel 1400), but the corresponding circular width of each of the designated award sections is geometrically or exponentially increased for each successive award wheel (i.e., from 1/24th of a circle for wheel 1200, to 1/12th of a circle for wheel 1300, to 1/6th of a circle for wheel 1400). However, it should be appreciated that in other embodiments of the present disclosure these ratios may vary.

In the illustrated example embodiment of FIG. 2, the game is a bonus game which is triggered during, from, or as a result of the play of a primary wagering game by a player. It should also be appreciated that any suitable bonus trigging event can be employed with this example bonus game embodiment.

Example Embodiment 3

Figure 3:
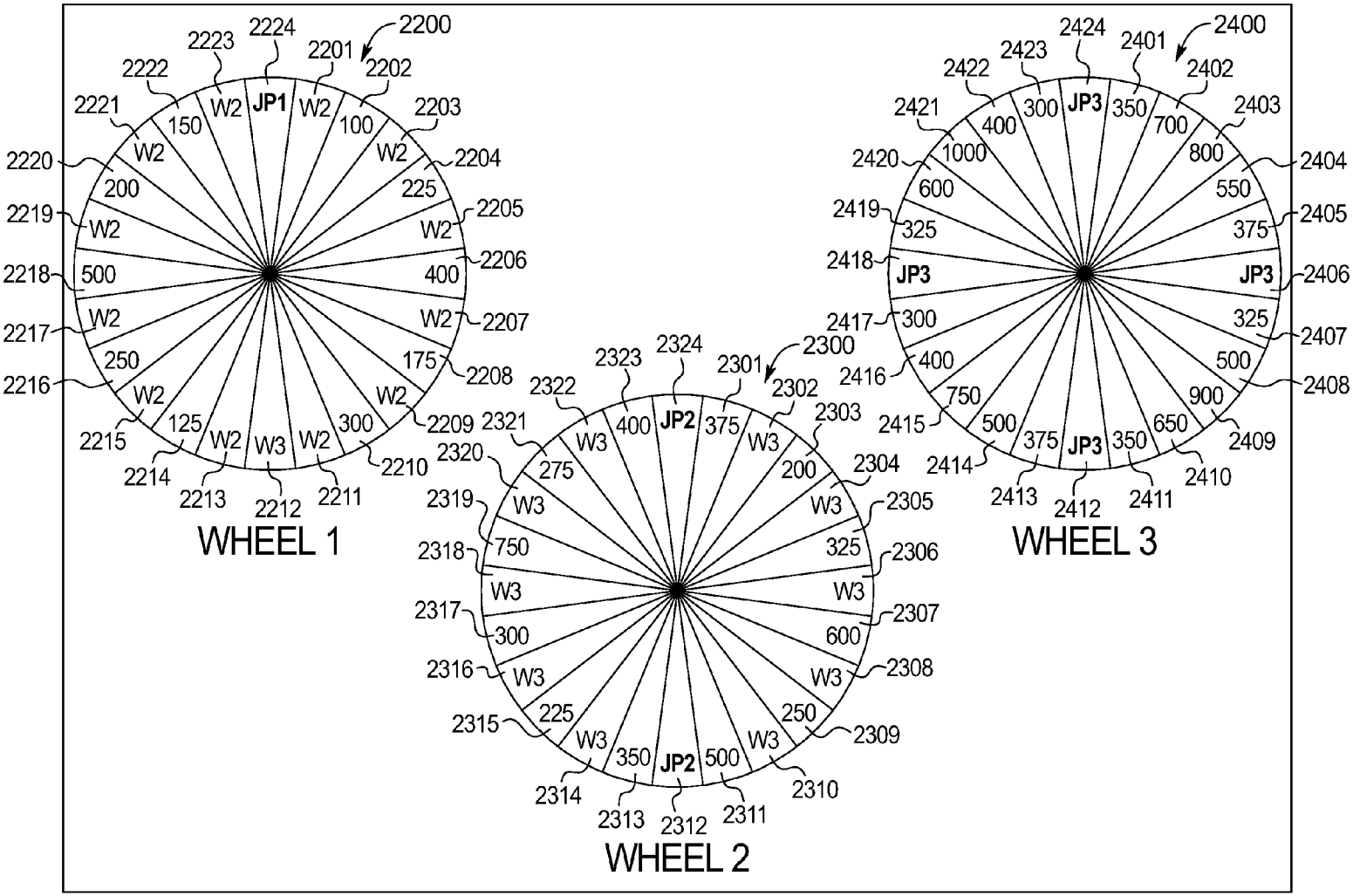
FIG. 3 is a front view of a display device displaying three award display wheels of a multiple award display game of another embodiment of the present disclosure.

Referring now to FIG. 3, the multiple un-weighted award displays of another example embodiment of a bonus game of one embodiment of the gaming system of the present disclosure is generally illustrated. This embodiment also includes three award displays which are in the form of three wheels 2200, 2300, and 2400 (respectively labeled WHEEL 1, WHEEL 2, and WHEEL 3). These wheels, the number of sections on these wheels, the probabilities of indicating each of the sections on each of these wheels, the transfers on the wheels to the other wheels, and the awards on these wheels are configured such that the designated awards (such as the jackpot awards represented by symbols JP1, JP2, and JP3) have a same probability of being won regardless of how many (i.e., 1, 2 or 3) of the wheels are activated.

More specifically, in this example embodiment, award display or wheel 2200 includes 24 sections 2201, 2202, 2203, 2204, 2205, 2206, 2207, 2208, 2209, 2210, 2211, 2212, 2213, 2214, 2215, 2216, 2217, 2218, 2219, 2220, 2221, 2222, 2223, and 2224. Wheel 2200 includes: (a) one designated award symbol and particularly jackpot award symbol (designated JP1) on section 2224; (b) award 100 on section 2202; (c) award 225 on section 2204; (d) award 400 on section 2206; (e) award 175 on section 2208; (f) award 300 on section 2210; (g) award 125 on section 2214; (h) award 250 on section 2216; (i) award 500 on section 2218; (j) award 200 on section 2220; and (k) award 150 on section 2222. Wheel 2200 further includes: (a) a transfer to wheel 2400 (designated W3) on section 2212; and (b) transfers to wheel 2300 (each designated W2) on each of sections 2201, 2203, 2205, 2207, 2209, 2211, 2213, 2215, 2217, 2219, 2221, and 2223. Each section of wheel 2200 has the same circular width (i.e., $1/24^{th}$ of a full circle) and has an equal chance or probability (i.e., a 1 in 24 chance or probability) of being indicated by a spin or activation of the wheel 2200. This wheel 2200 is thus considered to be un-weighted. Thus, wheel 2200 provides: (a) a 1/24 chance or probability of obtaining the designated award or jackpot award JP1; (b) a 10/24 (or 5/12) chance of obtaining one of the other awards on wheel 2200; (c) a 12/24 (1/2) chance of obtaining a transfer to wheel 2300; and (d) a 1/24 chance of obtaining a transfer to wheel 2400 (and thus a skip of wheel 2300). It should thus be appreciated that this embodiment provides a transfer or skip directly from wheel 2200 to wheel 2400. It should also be appreciated that this embodiment provides alternative orders for activation of the wheels (i.e., 1, 2, and 3; 1 and 3; and 2 and 3).

In this example embodiment, award display or wheel 2300 includes 24 sections 2301, 2302, 2303, 2304, 2305, 2306, 2307, 2308, 2309, 2310, 2311, 2312, 2313, 2314, 2315, 2316, 2317, 2318, 2319, 2320, 2321, 2322, 2323, and 2324. Wheel 2300 includes: (a) two designated award symbols and particularly two jackpot award symbols (each designated JP2) on sections 2312 and 2324; (b) award 375 on section 2301; (c) award 200 on section 2303; (d) award 325 on section 2305; (e) award 600 on section 2307; (f) award 250 on section 2309; (g) award 500 on section 2311; (h) award 350 on section 2313; (i) award 225 on section 2315; (j) award 300 on section 2317; (k) award 750 on section 2319; (l) award 275 on section 2321; and (m) award 400 on section 2323. Wheel 2300 further includes transfers to wheel 2400 (each designated W3) on each of sections 2302, 2304, 2306, 2308, 2310, 2314, 2316, 2318, 2320, and 2322. Each section of wheel 2300 has the same circular width (i.e., $1/24^{th}$ of a full circle) and has an equal chance or probability (i.e., a 1 in 24 chance or probability) of being indicated by a spin of the wheel 2300. This wheel 2300 is thus considered to be un-weighted. Thus, wheel 2300 provides: (a) a 2/24 (or 1/12) chance or probability of obtaining the designated award or jackpot award JP2; (b) a 12/24 (or 1/2) chance of obtaining one of the other awards on wheel 2300; and (c) a 10/24 (or 5/12) chance of obtaining a transfer to wheel 2400.

In this example embodiment, award display or wheel 2400 includes 24 sections 2401, 2402, 2403, 2404, 2405, 2406, 2407, 2408, 2409, 2410, 2411, 2412, 2413, 2414, 2415, 2416, 2417, 2418, 2419, 2420, 2421, 2422, 2423, and 2424. Wheel 2400 includes: (a) four designated award symbols and particularly four jackpot award symbols (designated JP3) on sections 2406, 2412, 2418, and 2424; (b) award 350 on section 2401; (c) award 700 on section 2402; (d) award 800 on section 2403; (e) award 550 on section 2404; (f) award 375 on section 2405; (g) award 325 on section 2407; (h) award 500 on section 2408; (i) award 900 on section 2409; (j) award 650 on section 2410; (k) award 350 on section 2411; (l) award 375 on section 2413; (m) award 500 on section 2414; (n) award 750 on section 2415; (o) award 400 on section 2416; (p) award 300 on section 2417; (q) award 325 on section 2419; (r) award 600 on section 2420; (s) award 1000 on section 2421; (t) award 400 on section 2422; and (u) award 300 on section 2423. In this example, wheel 2400 does not include any transfers to wheels 2200 or 2300. Each section of wheel 2400 has the same circular width (i.e., $1/24^{th}$ of a full circle) and has an equal chance or probability (i.e., a 1 in 24 chance or probability) of being indicated by a spin or activation of the wheel 400. This wheel 2400 is thus considered to be un-weighted. Thus, wheel 2400 provides: (a) a 4/24 (or 1/6) chance or probability of obtaining the designated award or jackpot award JP3; and (b) a 20/24 (or 5/6) chance of obtaining one of the other awards on wheel 2400.

From the above, it should be appreciated that each of the designated awards or jackpot awards (associated with the JP1, JP2, and JP3 symbols) is equally likely to be provided to the player regardless of the order of activation of these wheels and regardless of how many of the wheels are activated. More specifically, this configuration of wheels, awards, transfers, and probabilities provides the player with: (a) a 1/24 chance or probability of obtaining the JP1 symbol from the spin of the wheel 2200; (b) a 1/24 chance or probability of obtaining one of the JP2 symbols from the spins of the wheels 2200 and 2300 (i.e., (1/2 chance or probability of getting a transfer on wheel 2200 to wheel 2300)×(2/24 chance of getting the JP2 on wheel 2300)=2/48=1/24); and (c) 1/24 chance or probability of obtaining one of the JP3 symbols from the spins of the wheels 2200, 2300, and 2400 (i.e., ((1/24 chance or probability of getting a transfer on wheel 2200 to wheel 2400)+(1/2 chance or probability of getting a transfer on wheel 2200 to wheel 2300))×(10/24 chance or probability of getting a transfer on wheel 2300 to wheel 2400))=((2/48)+(10/48))=(12/48)=(1/4))×(4/24 chance of getting the JP3 on wheel 2400))=4/96=1/24).

In this example, (a) if only wheel 2200 is activated, then the player has a 1/24 chance or probability of winning the designated award JP1; (b) if only wheel 2200 and wheel 2300 are activated, then the player has a 1/24 chance or probability of winning the designated award JP2; (c) if wheel 2200 and wheel 2400 are activated, then the player has a 1/24 chance or probability of winning the designated award JP3; and (d) if wheel 2200, wheel 2300, and wheel 2400 are activated, then the player has a 1/24 chance or probability of winning the designated award JP3. Thus, regardless of the number of wheels activated, the chance or probability of winning one of the designated awards is the same for the player.

In one embodiment, the amount of each designated award JP1, JP2, and JP3 is the same for each of the wheels 2200, 2300, and 2400. In this embodiment the designated award has the same chance of occurring if one wheel is activated, two wheels are activated, or if all three of the wheels are activated. In other embodiments, two or more of the designated awards JP1, JP2, and JP3 are of different amounts. In one such embodiment, the JP3 award is greater than the JP2 award, and the JP2 award is greater than the JP1 award. In various embodiments, one or more of the designated awards JP1, JP2, and JP3 are progressive awards. In various embodiments, the designated awards JP1, JP2, and JP3 are multi-level progressive awards.

In the illustrated example embodiment of FIG. 3, once an award or designated award is won by the player, the bonus game ends and the other wheels are not activated.

In the illustrated example embodiment of FIG. 3, the quantity of designated awards is geometrically or exponentially increased for each successive award wheel (i.e., from 1 for wheel 2200, to 2 for wheel 2300, to 4 for wheel 2400). However, it should be appreciated that in other embodiments of the present disclosure these ratios may vary.

In the illustrated example embodiment of FIG. 3, the game is a bonus game which is triggered during, from, or as a result of the play of a primary wagering game by a player. It should also be appreciated that any suitable bonus trigging event can be employed with this example bonus game embodiment.

Example Embodiment 4

Figure 4:
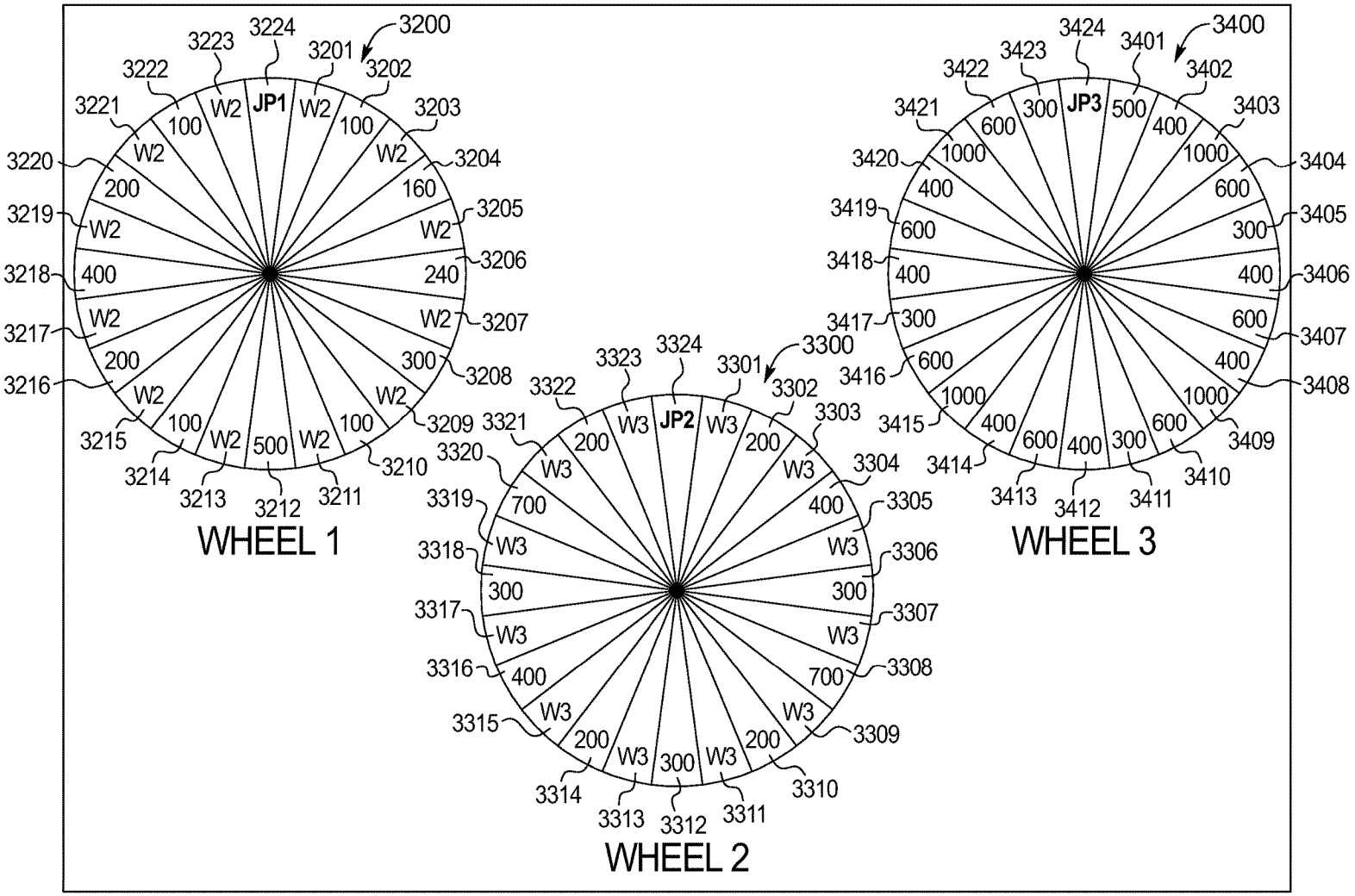
FIG. 4 is a front view of a display device displaying three award display wheels of a multiple award display game of another embodiment of the present disclosure.

Referring now to FIG. 4, the multiple un-weighted award displays of another example embodiment of a bonus game of the gaming system of the present disclosure is generally illustrated. This embodiment includes three award displays which are in the form of three wheels 3200, 3300, and 3400 (respectively labeled WHEEL 1, WHEEL 2, and WHEEL 3). These wheels, the number of sections on these wheels, the probabilities of indicating each of the sections on each of these wheels, the transfers on the wheels to the other wheels, and the awards on these wheels are configured such that the designated awards (such as the jackpot awards represented by symbols JP1, JP2, and JP3) have a decreasing probability of being won as each successive wheel is activated.

More specifically, in this example embodiment, award display or wheel 3200 includes 24 sections 3201, 3202, 3203, 3204, 3205, 3206, 3207, 3208, 3209, 3210, 3211, 3212, 3213, 3214, 3215, 3216, 3217, 3218, 3219, 3220, 3221, 3222, 3223, and 3224. Wheel 3200 includes: (a) one designated award symbol and particularly one jackpot award symbol (designated JP1) on section 3224; (b) award 100 on section 3202; (c) award 160 on section 3204; (d) award 240 on section 3206; (e) award 300 on section 3208; (f) award 100 on section 3210; (g) award 500 on section 3212; (h) award 100 on section 3214; (i) award 200 on section 3216; (j) award 400 on section 3218; (k) award 200 on section 3220; and (l) award 100 on section 3222. Wheel 3200 further includes transfers to wheel 3300 (each designated W2) on each of sections 3201, 3203, 3205, 3207, 3209, 3211, 3213, 3215, 3217, 3219, 3221, and 3223. Each section of wheel 3200 has the same circular width (i.e., $1/24^{th}$ of a full circle) and has an equal chance or probability (i.e., a 1 in 24 chance or probability) of being indicated by a spin or activation of the wheel 3200. This wheel 3200 is thus considered to be un-weighted. Thus, wheel 3200 provides: (a) a 1/24 chance or probability of obtaining the designated award or jackpot award JP1; (b) a 11/24 chance or probability of obtaining one of the other awards on wheel 3200; and (c) a 12/24 (or 1/2) chance or probability of obtaining a transfer to wheel 3300.

In this example embodiment, award display or wheel 3300 includes 24 sections 3301, 3302, 3303, 3304, 3305, 3306, 3307, 3308, 3309, 3310, 3311, 3312, 3313, 3314, 3315, 3316, 3317, 3318, 3319, 3320, 3321, 3322, 3323, and 3324. Wheel 3300 includes: (a) one designated award symbol and particularly one jackpot award symbol (designated JP2) on section 3324; (b) award 200 on section 3302; (c) award 400 on section 3304; (d) award 300 on section 3306; (e) award 700 on section 3308; (f) award 200 on section 3310; (g) award 300 on section 3312; (h) award 200 on section 3314; (i) award 400 on section 3316; (j) award 300 on section 3318; (k) award 700 on section 3320; and (l) award 200 on section 3322. Wheel 3300 further includes transfers to wheel 3400 (each designated W3) on each of sections 3301, 3303, 3305, 3307, 3309, 3311, 3313, 3315, 3317, 3319, 3321, and 3323. Each section of wheel 3300 has the same circular width (i.e., $1/24^{th}$ of a full circle) and has an equal chance or probability (i.e., a 1 in 24 chance or probability) of being indicated by a spin or activation of the wheel 3300. This wheel 3300 is thus considered to be un-weighted. Thus, wheel 3300 provides: (a) a 1/24 chance or probability of obtaining the designated award or jackpot award JP2; (b) a 11/24 chance or probability of obtaining one of the other awards on wheel 3300; and (c) a 12/24 (or 1/12) chance of obtaining a transfer to wheel 3400.

In this example embodiment, award display or wheel 3400 includes 24 sections 3401, 3402, 3403, 3404, 3405, 3406, 3407, 3408, 3409, 3410, 3411, 3412, 3413, 3414, 3415, 3416, 3417, 3418, 3419, 3420, 3421, 3422, 3423, and 3424. Wheel 3400 includes: (a) one designated award symbol and particularly one jackpot award symbol (designated JP3) on section 3424; (b) award 500 on section 3401; (c) award 400 on section 3402; (d) award 1000 on section 3403; (e) award 600 on section 3404; (f) award 300 on section 3405; (g) award 400 on section 3406; (h) award 600 on section 3407; (i) award 400 on section 3408; (j) award 1000 on section 3409; (k) award 600 on section 3410; (l) award 300 on section 3411; (m) award 400 on section 3412; (n) award 600 on section 3413; (o) award 400 on section 3414; (p) award 1000 on section 3415; (q) award 600 on section 3416; (r) award 300 on section 3417; (s) award 400 on section 3418; (t) award 600 on section 3419; (u) award 400 on section 3420; (v) award 1000 on section 3421; (w) award 600 on section 3422; and (x) award 300 on section 3423. In this example, wheel 3400 does not include any transfers to the wheel 3200 or the wheel 3300. Each section of wheel 3400 has the same circular width (i.e., $1/24^{th}$ of a full circle) and has an equal chance or probability (i.e., a 1 in 24 chance or probability) of being indicated by a spin or activation of the wheel 300. This wheel 3400 is thus considered to be un-weighted. Thus, wheel 3400 provides: (a) a 1/24 chance or probability of obtaining the designated award or jackpot award JP3; and (b) a 23/24 chance of obtaining one of the other awards on wheel 3400.

From the above, it should be appreciated that the respective designated awards or jackpot awards (associated with each of the JP1, JP2, and JP3 symbols) is successively less likely to be provided to the player with each subsequent spin or activation of these wheels. More specifically, this configuration of wheels, awards, transfers, and probabilities provides the player with: (a) a 1/24 chance or probability of obtaining the JP1 symbol from the spin of the wheel 3200; (b) a 1/48 chance or probability of obtaining the JP2 symbol from the spins of the wheels 3200 and 3300 (i.e., (1/2 chance or probability of getting a transfer on wheel 3200 to wheel 3300)×(1/24 chance of getting the JP2 on wheel 3300)=1/48); and (c) 1/96 chance or probability of obtaining of the JP3 symbol from the spins of the wheels 3200, 3300, and 3400 (i.e., the probability of spinning wheel 300=((1/2 chance or probability of getting a transfer on wheel 3200 to wheel 3300)×(1/2 chance or probability of getting a transfer on wheel 3300 to wheel 3400)×(1/24 chance or probability of getting the JP3 symbol on wheel 3400)=1/96).

In this example, (a) if only wheel 3200 is activated, then the player has a 1/24 chance or probability of winning a designated award; (b) if only wheel 3200 and wheel 3300 are activated, then the player has a 1/48 chance or probability of winning a designated award; and (c) if wheel 3200, wheel 3300, and wheel 3400 are activated, then the player has a 1/96 chance or probability of winning a designated award. Thus, the chance or probability of winning one of the designated awards (such as one of the jackpot awards) decreases for the player with each successive wheel spin for the player.

In one embodiment, the amount of each designated award JP1, JP2, and JP3 is the same for each of the wheels 3200, 3300, and 3400. In this embodiment the designated award has the same chance of occurring if one wheel is activated, two wheels are activated, or if all three of the wheels are activated. In other embodiments, two or more of the designated awards JP1, JP2, and JP3 are of different amounts. In one such embodiment, the JP3 award is greater than the JP2 award, and the JP2 award is greater than the JP1 award. In various embodiments, one or more of the designated awards JP1, JP2, and JP3 are progressive awards. In various embodiments, the designated awards JP1, JP2, and JP3 are multi-level progressive awards.

In the illustrated example embodiment of FIG. 4, once an award or designated award is won by the player, the bonus game ends and the other wheels are not activated.

In the illustrated example embodiment of FIG. 4, the quantity of designated awards remains the same for each successive award wheel (i.e., 1 for wheel 2300, 1 for wheel 3300, and 1 for wheel 3400). However, it should be appreciated that in other embodiments of the present disclosure these ratios may vary.

In the illustrated example embodiment of FIG. 4, the game is a bonus game which is triggered during, from, or as a result of the play of a primary wagering game by a player. It should also be appreciated that any suitable bonus trigging event can be employed with this example bonus game embodiment.

Example Embodiment 5

Figure 5:
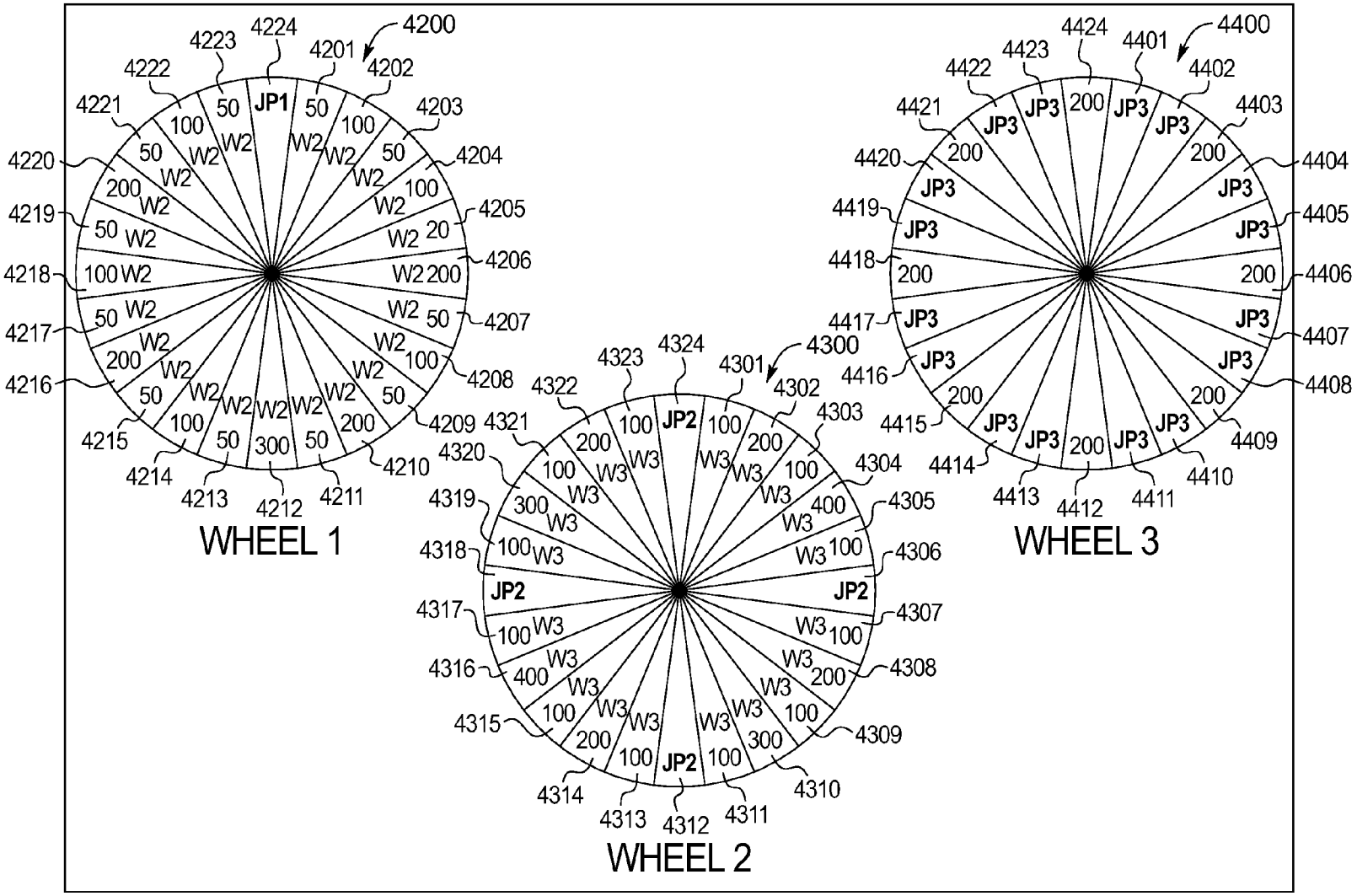
FIG. 5 is a front view of a display device displaying three award display wheels of a multiple award display game of another embodiment of the present disclosure.

Referring now to FIG. 5, the multiple un-weighted award displays of another example embodiment of a bonus game of the gaming system of the present disclosure is generally illustrated. This embodiment includes three award displays which are in the form of three wheels 4200, 4300, and 4400 (respectively labeled WHEEL 1, WHEEL 2, and WHEEL 3). These wheels, the number of sections on these wheels, the probabilities of indicating each of the sections on each of these wheels, the transfers on the wheels to the other wheels, and the awards on these wheels are configured such that each successive designated award (such as each successive jackpot award represented by symbols JP1, JP2, and JP3) has an increasing probability of being won.

More specifically, in this example embodiment, award display or wheel 4200 includes 24 sections 4201, 4202, 4203, 4204, 4205, 4206, 4207, 4208, 4209, 4210, 4211, 4212, 4213, 4214, 4215, 4216, 4217, 4218, 4219, 4220, 4221, 4222, 4223, and 4224. Wheel 4200 includes: (a) one designated award symbol and particularly one jackpot award symbol (designated JP1) on section 4224; (b) award 50 on section 4201; (c) award 100 on section 4202; (d) award 50 on section 4203; (e) award 100 on section 4204; (f) award 20 on section 4205; (g) award 200 on section 4206; (h) award 50 on section 4207; (i) award 100 on section 4208; (j) award 50 on section 4209; (k) award 200 on section 4210; (l) award 50 on section 4211; (m) award 300 on section 4212; (n) award 50 on section 4213; (o) award 100 on section 4214; (p) award 50 on section 4215; (q) award 200 on section 4216; (r) award 50 on section 4217; (s) award 100 on section 4218; (t) award 50 on section 4219; (u) award 200 on section 4220; (v) award 50 on section 4221; (w) award 100 on section 4222; and (x) award 50 on section 4223. Additionally, transfers to wheel 4300 (each designated W2) are associated with each of the sections except for section 4224 (i.e., transfers are associated with sections 4201, 4202, 4203, 4204, 4205, 4206, 4207, 4208, 4209, 4210, 4211, 4212, 4213, 4214, 4215, 4216, 4217, 4218, 4219, 4220, 4221, 4222, and 4223). Each section of wheel 4200 has the same circular width (i.e., $1/24^{th}$ of a full circle) and has an equal chance or probability (i.e., a 1 in 24 chance or probability) of being indicated by a spin or activation of the wheel 4200. This wheel 4200 is thus considered to be un-weighted. Thus, wheel 4200 provides: (a) a 1/24 chance or probability of obtaining the designated award or jackpot award JP1; (b) a 23/24 chance or probability of obtaining one of the other awards on wheel 4200; and (c) a chance or probability of obtaining a transfer to wheel 4300.

In this example embodiment, award display or wheel 4300 includes 24 sections 4301, 4302, 4303, 4304, 4305, 4306, 4307, 4308, 4309, 4310, 4311, 4312, 4313, 4314, 4315, 4316, 4317, 4318, 4319, 4320, 4321, 4322, 4323, and 4324. Wheel 4300 includes: (a) four designated award symbols and particularly four jackpot award symbols (each designated JP2) on sections 4306, 4312, 4318, and 4324; (b) award 100 on section 4301; (c) award 200 on section 4302; (d) award 100 on section 4303; (e) award 400 on section 4304; (f) award 100 on section 4305; (g) award 100 on section 4307; (h) award 200 on section 4308; (i) award 100 on section 4309; (j) award 300 on section 4310; (k) award 100 on section 4311; (l) award 100 on section 4313; (m) award 200 on section 4314; (n) award 100 on section 4315; (o) award 400 on section 4316; (p) award 100 on section 4317; (q) award 100 on section 4319; (r) award 300 on section 4320; (s) award 100 on section 4321; (t) award 200 on section 4322; and (u) award 100 on section 4323. Wheel 4300 further includes transfers to wheel 4400 (each designated W3) on each of sections 4301, 4302, 4303, 4304, 4305, 4307, 4308, 4309, 4310, 4311, 4313, 4314, 4315, 4316, 4317, 4319, 4320, 4321, 4322, and 4323. Each section of wheel 4300 has the same circular width (i.e., $1/24^{th}$ of a full circle) and has an equal chance or probability (i.e., a 1 in 24 chance or probability) of being indicated by a spin or activation of the wheel 4300. This wheel 4300 is thus considered to be un-weighted. Thus, wheel 4300 provides: (a) a 4/24 (or 1/6) chance or probability of obtaining the designated award or jackpot award JP2; (b) a 20/24 (or 5/6) chance of obtaining a transfer to wheel 4400.

In this example embodiment, award display or wheel 4400 includes 24 sections 4401, 4402, 4403, 4404, 4405, 4406, 4407, 4408, 4409, 4410, 4411, 4412, 4413, 4414, 4415, 4416, 4417, 4418, 4419, 4420, 4421, 4422, 4423, and 4424. Wheel 4400 includes: (a) sixteen designated award symbols and particularly sixteen jackpot award symbols (designated JP3) on sections 4401, 4402, 4404, 4405, 4407, 4408, 4410, 4411, 4413, 4414, 4416, 4417, 4419, 4420, 4422, and 4423; (b) award 200 on section 4403; (c) award 200 on section 4406; (d) award 200 on section 4409; (e) award 200 on section 4412; (f) award 200 on section 4415; (g) award 200 on section 4418; (h) award 200 on section 4421; and (i) award 200 on section 4424. In this example, wheel 4400 does not include any transfers to the wheel 4200 or the wheel 4300. Each section of wheel 4400 has the same circular width (i.e., $1/24^{th}$ of a full circle) and has an equal chance or probability (i.e., a 1 in 24 chance or probability) of being indicated by a spin or activation of the wheel 4400. This wheel 4400 is thus considered to be un-weighted. Thus, wheel 4400 provides: (a) a 16/24 (or 2/3) chance or probability of obtaining the designated award or jackpot award JP3; and (b) a 8/24 (or 1/3) chance or probability of obtaining one of the other awards on wheel 4400.

In other embodiments (not shown in the drawings), one or more sections on one or more wheels has only an award value. In other embodiments (not shown in the drawings), one or more sections on one or more wheels has only a transfer indictor.

From the above, it should be appreciated that each designated award or jackpot award (associated with each of the JP1, JP2, and JP3 symbols) is successively more likely to be provided to the player as each successive wheel is activated. More specifically, this configuration of wheels, awards, transfers, and probabilities provides the player with: (a) a 1/24 chance or probability of obtaining the JP1 symbol from the spin of the wheel 4200; (b) a 23/144 chance or probability of obtaining one of the JP2 symbols from the spins of the wheel 4300 (i.e., (23/24 chance or probability of getting a transfer on wheel 4200 to wheel 4300)×(1/6 chance of getting the JP2 on wheel 4300)=23/144); and (c) 253/432 chance or probability of obtaining one of the JP3 symbols from the spins of the wheels 4200, 4300, and 4400 (i.e., ((23/24 chance or probability of getting a transfer on wheel 4200 to wheel 4300)×(5/6 chance or probability of getting a transfer on wheel 4300 to wheel 4400)×(2/3 chance of getting the JP3 on wheel 4400))=230/432.)

In one embodiment, the amount of each designated award JP1, JP2, and JP3 is the same for each of the wheels 4200, 4300, and 4400. In this embodiment the designated award has the same chance of occurring if one wheel is activated, two wheels are activated, or if all three of the wheels are activated. In other embodiments, two or more of the designated awards JP1, JP2, and JP3 are of different amounts. In one such embodiment, the JP3 award is greater than the JP2 award, and the JP2 award is greater than the JP1 award. In various embodiments, one or more of the designated awards JP1, JP2, and JP3 are progressive awards. In various embodiments, the designated awards JP1, JP2, and JP3 are multi-level progressive awards.

It should also be appreciated that in using the structure of this embodiment, the largest award can be the designated award JP1 on the first wheel 4200, an intermediate sized award can be the designated award JP2 on the second wheel 4300, and the smallest designated award can be the designated award JP3 on the third wheel 4400. This enables the player to always have a chance to win the largest designated award (assuming that the play of this bonus game always starts with the first wheel). Further, in this embodiment, if the player does not win the designated award JP1, the player is more likely to win the designated award JP2, and if the player does not win the designated award JP2, the player is even more likely to win the designated award JP3.

In the illustrated example embodiment of FIG. 5, once an award or designated award is won by the player, the bonus game ends and the other wheels are not activated.

In the illustrated example embodiment of FIG. 5, the quantity of designated awards is geometrically or exponentially increased for each successive award wheel (i.e., from 1 for wheel 4200, to 4 for wheel 4300, to 16 for wheel 4400). However, it should be appreciated that in other embodiments of the present disclosure these ratios may vary.

In the illustrated example embodiment of FIG. 5, the game is a bonus game which is triggered during, from, or as a result of the play of a primary wagering game by a player. It should also be appreciated that any suitable bonus trigging event can be employed with this example bonus game embodiment.

Example Embodiment 6

A further alternative embodiment (not shown in the drawings) provides multiple un-weighted award displays of a bonus game of the gaming system of the present disclosure. This embodiment includes three award displays which are in the form of three wheels. These wheels, the number of sections on these wheels, the probabilities of indicating each of the sections on each of these wheels, the transfers on the wheels to the other wheels, and the awards on these wheels are configured such that each designated award (such as each jackpot award) has a same probability of being won. In this example embodiment, each of the designated awards are on each of the wheels, and each successive wheel has a greater quantity of each of the designated awards.

More specifically, in this example embodiment, the first wheel has 24 equal sized sections and each section of the first wheel has an equal chance or probability (i.e., a 1 in 24 chance or probability) of being indicated by a spin or activation of the first wheel. This first wheel is thus considered to be un-weighted. In this embodiment, (a) the designated award JP1 has a 4.2% chance or probability of being won on the first wheel, (b) the designated award JP2 has a 4.2% chance or probability of being won on the first wheel, (c) the designated award JP3 has a 4.2% chance or probability of being won on the first wheel, (d) a transfer or advance to the second wheel has a 50% chance or probability of occurring on the first wheel, and (e) another award or outcome has a 37.5% chance or probability of occurring on the first wheel.

In this example embodiment, the second wheel has 24 equal sized sections and each section of the second wheel has an equal chance or probability (i.e., a 1 in 24 chance or probability) of being indicated by a spin or activation of the second wheel. This second wheel is thus considered to be un-weighted. In this embodiment, (a) the designated award JP1 has a 8.3% chance or probability of being won on the second wheel, (b) the designated award JP2 has a 8.3% chance or probability of being won on the second wheel, (c) the designated award JP3 has a 8.3% chance or probability of being won on the second wheel, (d) a transfer or advance to the third wheel has a 50% chance or probability of occurring on the second wheel, and (e) another award or outcome has a 25.0% chance or probability of occurring on the second wheel.

In this example embodiment, the third wheel has 24 equal sized sections and each section of the second wheel has an equal chance or probability (i.e., a 1 in 24 chance or probability) of being indicated by a spin or activation of the third wheel. This third wheel is thus considered to be un-weighted. In this embodiment, (a) the designated award JP1 has a 16.7% chance or probability of being won on the third wheel, (b) the designated award JP2 has a 16.7% chance or probability of being won on the third wheel, (c) the designated award JP3 has a 16.7% chance or probability of being won on the third wheel, and (d) another award or outcome has approximately a 50.0% (i.e., 49.9%) chance or probability of occurring on the third wheel.

In this example embodiment, (a) the designated award JP1 has a 12.5% overall chance or probability of being won, (b) the designated award JP2 has a 12.5% overall chance or probability of being won, and (c) the designated award JP3 has a 12.5% overall chance or probability of being won.

Additional Alternative Embodiments

It should be appreciated that the award displays of the present disclosure can be video award displays or mechanical award displays.

In the illustrated embodiments described above, the award displays are wheels each having an outwardly facing side with the sections and symbols displayed on the outwardly facing side. In alternative embodiments, one or more of the award displays is a wheel having an outwardly facing edge with the sections and symbols displayed on the outwardly facing edge. In further alternative embodiments, one or more of the award displays are reels. In further alternative embodiments, one or more of the award displays are clock-like spinners. In further alternative embodiments, one or more of the award displays include chase lights. In further alternative embodiments, one or more of the award displays include roulette style mechanisms. In further alternative embodiments, one or more of the award displays are platonic solids (such as multiple sided dice).

In various embodiments, all of the award displays are of the same type. In other various embodiments, two or more of the award displays are of different types.

The illustrated embodiments described above all have three award displays. It should be appreciated that the quantity of award displays may be two, or may be more than three in various alternative embodiments. It should also be appreciated that the number of sections on each set or group of award displays may vary in accordance with the present disclosure. It should also be appreciated that the number of transfers to other award displays may vary in accordance with the present disclosure. It should further be appreciated that the number of award symbols on the award displays may vary in accordance with the present disclosure.

For example, in one alternative embodiment, the un-weighted award displays includes two 24 section wheels. The first un-weighted wheel includes: (a) 1 designated award symbol (JP1); (b) 8 transfer to second wheel sections and thus provides a 1/3 chance or probability of the transfer to the second wheel; and (c) 15 award symbol sections. The second un-weighted wheel includes: (a) 3 designated award symbols (JP2); and (b) 21 award symbol sections. Thus, in this example embodiment, the player has a 1/24 chance of winning the designated award JP1 and a 1/24 chance of winning the designated award JP2.

As mentioned above, the awards on each award display may vary in accordance with the present disclosure. It should also be appreciated that the types of awards may in accordance with the present disclosure. For example, the designated awards in the above example embodiments can be progressive awards; however, it should be appreciated that one or more of the designated awards may be entries into a bonus game. The bonus game entries may vary with different value bonus parameters such as different quantities of free activations, different quantities of picks, different quantities of pointers, different progressive value, etc. It should also be appreciated that one or more of the designated awards may be "as-is" prizes such as an automobile. It should further be appreciated that one or more of the sections on one or more of the award displays, may include no award or positive outcome for the player.

It should be appreciated from the above that one or more of the award displays can include one or more sections that enable one or more of the award displays to be skipped. For example, in the above embodiment illustrated in FIG. 3, the first wheel has a transfer or advancement from the first wheel to the third wheel. These embodiments provide for skipping one or more award displays as well as providing for the successive progression through the set of award displays. It should also be appreciated that in alternative embodiments, the transfer to a subsequent award display can be obtained: (a) only by obtaining a transfer to subsequent wheel outcome; (b) only by obtaining a designated award symbol; or (c) by obtaining a transfer to subsequent wheel outcome or by obtaining a designated award symbol It should be appreciated from the above that one or more of the award displays can include one or more sections with multiple outcomes. For example, in the above embodiment illustrated in FIG. 5, award symbols and transfer symbols are associated with all of the sections of wheel 1 of FIG. 5 except the JP1 symbol.

In various alternative embodiments, the results on one award display can affect awards on one or more other or subsequent award displays. For example, obtaining an award of a 3× multiplier on wheel 1 with a transfer causes one or more of the awards on wheel 2 to be multiplied by three. In another example, obtaining a specific outcome causes an extra designated award symbol to replace a standard award symbol on one or more of the other award displays. In another example, each award display is successively improved until an award is won by the player.

It should be appreciated that the award displays (such as the wheels) can be oriented or arranged in any suitable manner. In certain embodiments, the award displays (such as the wheels) are adjacently arranged as shown in FIGS. 1 to 5, in other embodiments the award displays (such as the wheels) are arranged in overlapping fashion, and in other embodiments the award displays (such as the wheels) are successively displayed (i.e., such as one at a time).

It should be appreciated that in other embodiments, the bonus game of one or more of the embodiments may not be started at the first award display (such as the first wheel) but rather at the second award display (such as the second wheel).

It should be appreciated that the probabilities as well as the awards can be slightly unequal (or substantially equal) in certain embodiments.

In the above example embodiments, the sections within each wheel have equal circular width. In other embodiments, a given wheel has sections with two or more different circular widths, such as a wheel with 22 sections each of 1/24th of circular width, and a double-wide sector of 2/24ths of the circular width. In such an embodiment, the wheel is considered un-weighted if the probability of selection of each sector is exactly proportional to said sector's circular width.

In the above example embodiments, every wheel is completely un-weighted. In other embodiments, one or more of the wheels employs weighting in accordance with the present disclosure. In certain variations, such weighting is influenced by play factors such as player wager size, player wager history, player loyalty status, player-specific bonusing, game-specific bonusing, time-specific bonusing, etc.

In various alternative embodiments, the quantity of transfer sections varies based on another factor such as the status of the player. That status could be defined by the player's bet size, player's reward club standing, accumulation of virtual in-game currency, and/or accumulation of in-game titles. For example, a player who has leveled up to "Titan" status might gain 2 additional transfers on wheel 1 to wheel 2 and 1 additional transfer on wheel 2 to wheel 3. The addition of more transfers may be designed to increase the odds of getting one or more jackpot awards, or to increase the odds to winning any one of the jackpot awards while still maintaining an equal chance of winning any of the Jackpot awards.

Figure 6:
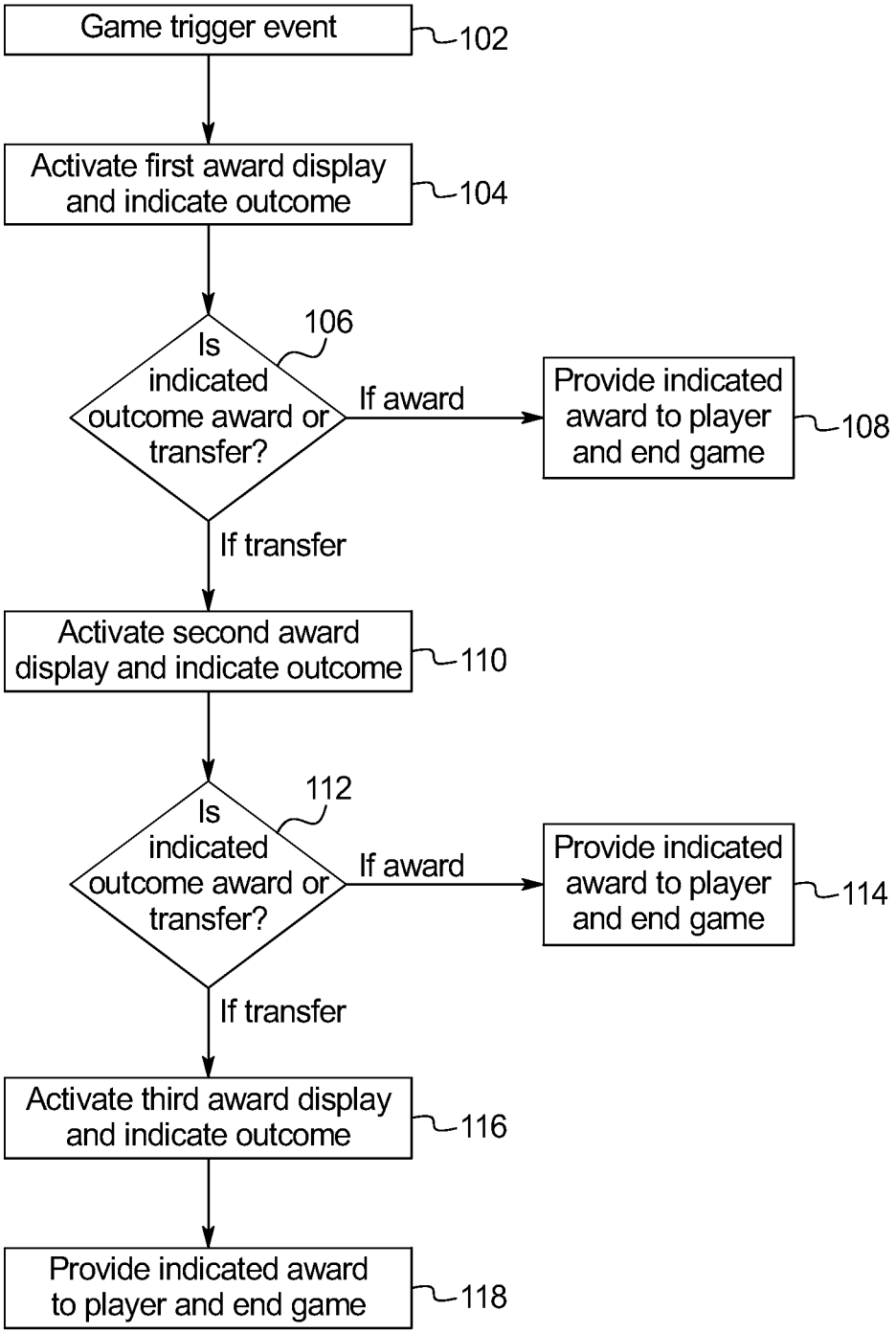
FIG. 6 is a flow chart an example process for operating a gaming system providing the multiple award display game of one embodiment of the present disclosure.

Referring now to FIG. 6, a flowchart of a simple example embodiment of a process for operating one embodiment of gaming system disclosed herein is illustrated. In one embodiment, this process is embodied in one or more software programs stored in one or more memories and executed by one or more processors or servers. Although this process is described with reference to the flowchart illustrated in FIG. 6, it should be appreciated that many other methods of performing the acts associated with this process may be used. For example, the order of certain steps described may be changed, or certain steps described may be optional. It should also be appreciated that this example does not represent all of the above example embodiments.

In various embodiments, upon an occurrence of a secondary game or bonus game triggering event, as indicated by block 102 of FIG. 6, the gaming system initiates or triggers a play of a multiple award display game of the present disclosure. After the triggering event, the gaming system activates the first award display and causes the first award display to indicate one of the outcomes of the first award display as indicated by block 104. As mentioned above, the award display may be activated automatically or upon receipt from a player of a requested input. If the indicated outcome of the first award display is an award or a designated award, the gaming system provides the award or designated award to the player as indicated by diamond 106 and block 108. If the indicated outcome is a transfer to a second award display, the gaming system activates the second award display as indicated by diamond 106 and block 110. If the indicated outcome of the second award display is an award or a designated award, the gaming system provides the award or designated award to the player as indicated by diamond 112 and block 114. If the indicated outcome is a transfer to a third award display, the gaming system activates the third award display as indicated by diamond 112 and block 116. In this example embodiment, there are only three award displays, and the gaming system provides any award associated with the indicated outcome of the third award display to the player as indicated by block 118. It should be appreciated that any suitable bonus trigging event can be employed with this example embodiment.

It should also be appreciated from the above, that the gaming system and method of the present disclosure provides different variations of games which have: (1) equal probabilities of providing designated awards using award displays with equal quantities of sections; (2) equal probabilities of providing designated awards using award displays with different quantities of sections; (3) geometrically decreasing probabilities of providing designated awards using award displays with equal quantities of sections; and (4) geometrically increasing probabilities of providing designated awards using award displays with equal quantities of sections.

It should further be appreciated that any of the determinations disclosed herein can be predetermined, randomly determined, randomly determined based on one or more weighted percentages, determined based on a generated symbol or symbol combination, determined independent of a generated symbol or symbol combination, determined based on a random determination by the central controller, determined independent of a random determination by the central controller, determined based on a random determination at the gaming system, determined independent of a random determination at the gaming system, determined based on at least one play of at least one game, determined independent of at least one play of at least one game, determined based on a player's selection, determined independent of a player's selection, determined based on one or more side wagers placed, determined independent of one or more side wagers placed, determined based on the player's primary game wager, determined independent of the player's primary game wager, determined based on time (such as the time of day), determined independent of time (such as the time of day), determined based on an amount of coin-in accumulated in one or more pools, determined independent of an amount of coin-in accumulated in one or more pools, determined based on a status of the player (i.e., a player tracking status), determined independent of a status of the player (i.e., a player tracking status), determined based on one or more other determinations disclosed herein, determined independent of any other determination disclosed herein or determined based on any other suitable method or criteria.

As demonstrated by various of the above example embodiments, to implement a specific series of probabilities for two or more designated awards, the configuration of the award displays (such as the wheels) fulfill the following equation for each designated award type: probability(special win j)=$\Sigma$(x(k)*y(j,k)) summed across all wheels where x=probability(wheel k spin) and y=probability (outcome j given wheel k spin).

For various implementations with the characteristics of the FIG. 1 wheels (where all of the wheels have a same number of equal-sized sections, each wheel has its own unique jackpot award, each wheel has at least one regular award, wheel transfers only occurring in strict sequence, and which provides equi-probable jackpot wins), the number of sections per wheel should be an integer multiple of 2 to the power of w, where w is the number of wheels. For the example of FIG. 1, w=3, so that the number of sections needed to be an integer is a multiple of 8. This section number guideline also holds true for implementations with the characteristics of the FIG. 4 wheels (where all wheels have the same number of equal-sized sections, each wheel has its own unique jackpot award, each wheel has at least one regular award, wheel transfers only occur in strict sequence, and the jackpot award probability of the jackpot win on wheel j is ½ the probability of win on wheel j−1, for all j>1).

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines ("EGMs"); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 7A:
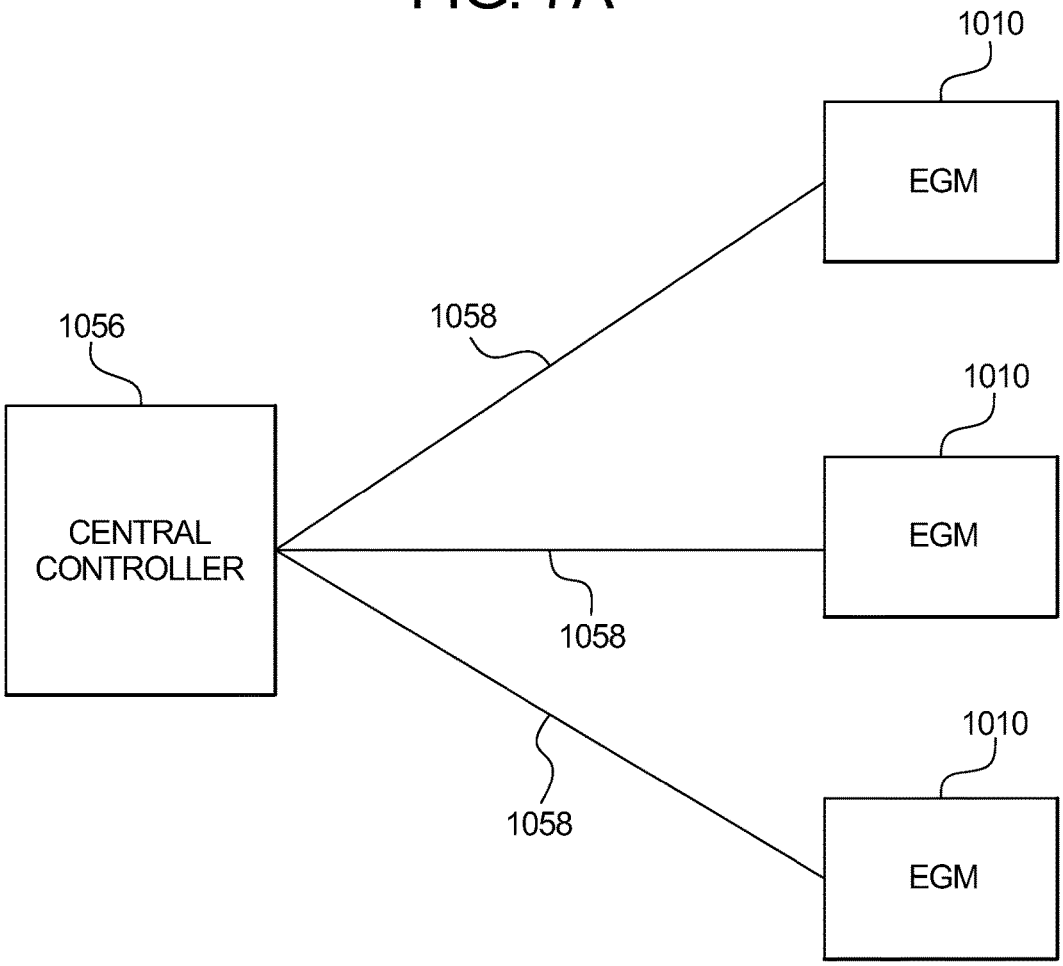
FIG. 7A is a schematic block diagram of one embodiment of a network configuration of the gaming system disclosed herein.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 7A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described herein, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central server, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 7B:
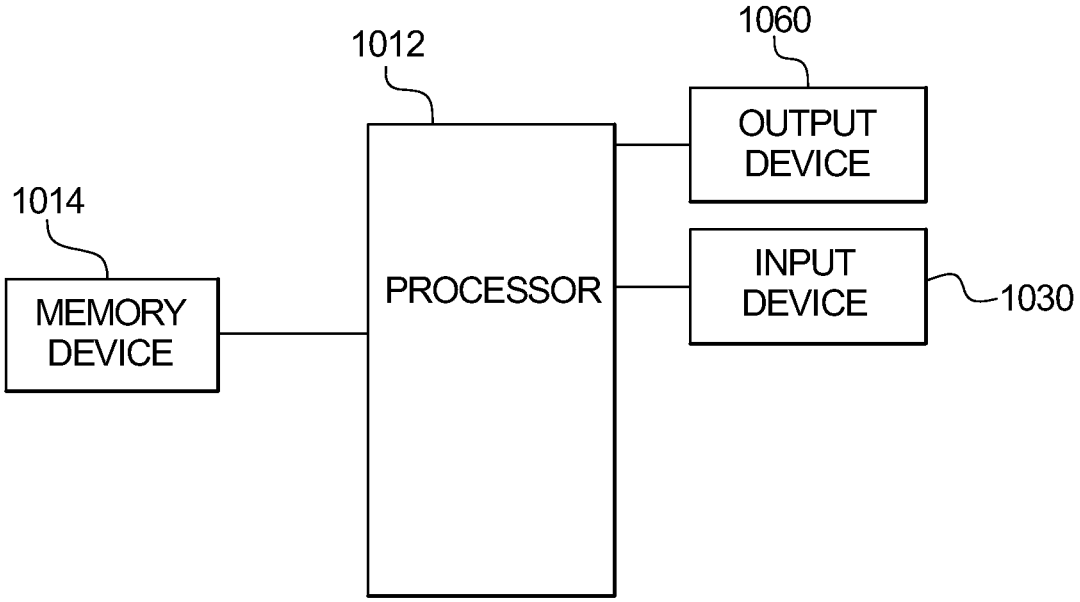
FIG. 7B is a schematic block diagram of one embodiment of an electronic configuration of the gaming system disclosed herein.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 7B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include nonvolatile RAM (NVRAM), magnetic RAM (MRAM), ferroelectric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 7B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 8A:
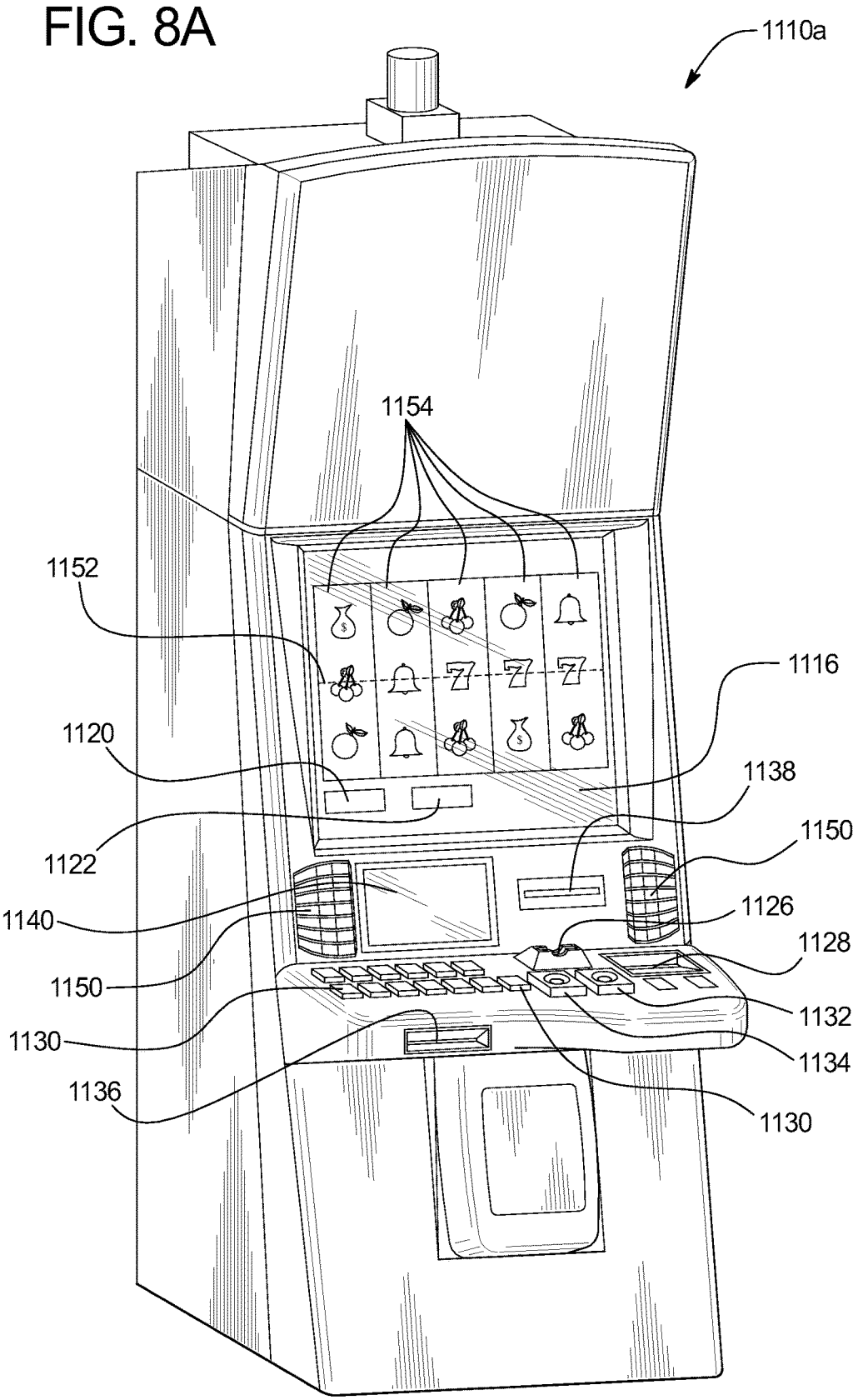
FIGS. 8A and 8B are perspective views of example alternative embodiments of the gaming system disclosed herein.
Figure 8B:
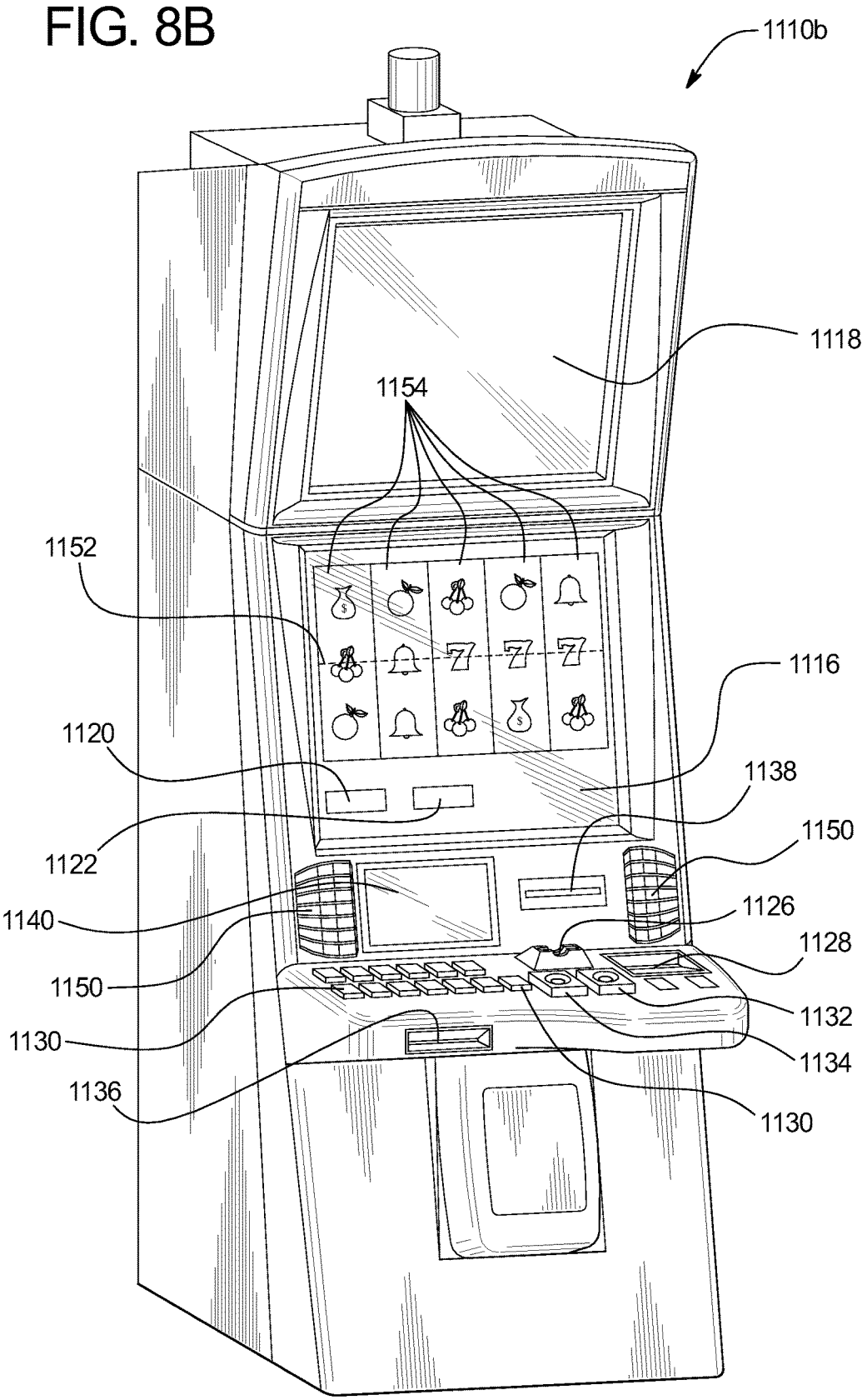

In various embodiments, the EGM includes one or more input devices. The input devices may include any suitable device that enables an input signal to be produced and received by the at least one processor of the EGM. The example EGM illustrated in FIG. 7B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 8A and 8B illustrate example EGMs 1110*a* and 1110*b* that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 8A and 8B each include a game play activation device in the form of a game play initiation button 1132. It should be appreciated that, in other embodiments, the EGM begins game play automatically upon appropriate funding rather than upon utilization of the game play activation device.

In certain embodiments, one or more input devices of the EGM are one or more wagering or betting devices 1130. One such wagering or betting device 1130 is as a maximum wagering or betting device that, when utilized, causes a maximum wager to be placed. Another such wagering or betting device 1130 is a repeat the bet device that, when utilized, causes the previously-placed wager to be placed. A further such wagering or betting device 1130 is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one. It should be appreciated that while the player's credit balance, the player's wager, and any awards are displayed as an amount of monetary credits or currency in the embodiments described herein, one or more of such player's credit balance, such player's wager, and any awards provided to such player may be for non-monetary credits, promotional credits, and/or player tracking points or credits.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 8A and 8B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 8A and 8B each include a card reader 1138. The card reader is configured to read a player identification card inserted into the card reader.

In various embodiments, the EGM includes one or more output devices. The example EGM illustrated in FIG. 7B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 8A includes a central display device 1116, a player tracking display 1140, a credit display 1120, and a bet display 1122. The example EGM illustrated in FIG. 3B includes a central display device 1116, an upper display device 1118, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 8A and 8B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 8A and 8B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 8A and 8B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 8A and 8B, EGMs may have varying cabinet and display configurations.

It should be appreciated that, in certain embodiments, the EGM is a device that has obtained approval from a regulatory gaming commission, and in other embodiments, the EGM is a device that has not obtained approval from a. regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 8A and 8B each include a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display positions on a requisite number of adjacent reels. In one such embodiment, one or more paylines are formed between at least two symbol display positions that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display positions, the gaming system enables a wager to be placed on a plurality of symbol display positions, which activates those symbol display positions.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display positions on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game (s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

In various embodiments, the third wheel, for example wheel 400 in FIG. 1, wheel 1400 in FIG. 2, wheel 2400 in FIG. 3, wheel 3400 in FIG. 4, wheel 4400 in FIG. 5, may include one or more transfers to the other wheels. Specifically, the third wheel may include one or more transfers to the first wheel, for example, wheel 200 in FIG. 1, wheel 1200 in FIG. 2, wheel 2200 in FIG. 3, wheel 3200 in FIG. 4, wheel 4200 in FIG. 5.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming system comprising:

a housing;

a plurality of input devices supported by the housing, said plurality of input devices including:

(i) an acceptor, and (ii) a cashout device;

at least one display device supported by the housing;

at least one processor; and at least one memory device which stores a plurality of instructions, which when executed by the at least one processor, cause the at least one processor to:

(1) establish a credit balance based, at least in part, on a monetary value associated with a physical item received via the acceptor;

(2) cause an initiation of any payout associated with the credit balance when a cashout input is received via the cashout device;

(3) operate with the at least one display device to display:

(i) a first award display, said first award display including a plurality of sections, each section having a same first probability of being indicated, a first designated award associated with each of a first quantity of said sections of the first award display, said first quantity being at least one, a transfer to a second award display associated with a second quantity of said sections of the first award display, said second quantity being at least one, and a plurality of other awards associated with a third quantity of said sections of the first award display, said third quantity being at least two, and (ii) the second award display, said second award display including a plurality of sections, each section having a same second probability of being indicated, a second designated award associated with each of a fourth quantity of said sections of the second award display, said fourth quantity being at least one, and a plurality of other awards associated with a fifth quantity of said sections of the second award display, said fifth quantity being at least two;

(4) operate with the at least one display device to display a play of a game, wherein the first award display, the sections of the first award display, the second award display, the sections of the second award display, the first probability, and the second probability are configured such that the first designated award and the second designated award have a same probability of being won before and for the play of the game; and the display of the play of the game including:

(a) activating the first award display and indicating one of the sections of said first award display, (b) when the indicated section of the first award display is associated with the first designated award, providing said first designated award to a player, (c) when the indicated section of the first award display is associated with one of the other awards, providing said award to the player, and (d) when the indicated section of the first award display is associated with the transfer to the second award display, activating the second award display and indicating one of the sections of said second award display, and (i) when the indicated section of the second award display is associated with the second designated award, providing said second designated award to the player, and (ii) when the indicated section of the second award display is associated with one of the other awards, providing said award to the player; and (5) adjust the credit balance based on the play of the game.

2. The gaming system of claim 1, wherein the award displays are wheels.

3. The gaming system of claim 1, wherein the first designated award and the second designated awards are different awards.

4. The gaming system of claim 1, wherein the first designated award and the second designated award are different progressive awards.

5. The gaming system of claim 1, wherein the plurality of instructions, when executed by the at least one processor, cause the at least one processor to operate with the at least one display device to display a third award display, said third award display including a plurality of sections, each section having a same third probability of being indicated, a third designated award associated with each of a sixth quantity of said sections of the third award display, said sixth quantity being at least one, a transfer to the first award display associated with a seventh quantity of said sections of the third award display, said seventh quantity being at least one, and a plurality of other awards associated with an eighth quantity of said sections of the third award display, said eighth quantity being at least two, and wherein the display of the play of the game includes: (a) before activating the first award display, activating the third award display and indicating one of the sections of said third award display, and (b) when the indicated section of the third award display is associated with the transfer to the first award display, activating the first award display.

6. A gaming system comprising:

a housing;

a plurality of input devices supported by the housing, said plurality of input devices including:

(i) an acceptor;

(ii) a cashout device;

at least one display device supported by the housing;

at least one processor; and at least one memory device which stores a plurality of instructions, which when executed by the at least one processor, cause the at least one processor to:

(1) establish a credit balance based, at least in part, on a monetary value associated with a physical item received via the acceptor;

(2) cause an initiation of any payout associated with the credit balance when a cashout input is received via the cashout device;

(3) operate with the at least one display device to display a plurality of award displays, including a first award display and a second award display, the first award display including a plurality of first sections, the second award display including a plurality of second sections, a first designated award associated with each of a first quantity of said first sections, said first quantity of said first sections being at least one, a transfer from the first award display to one of the plurality of award displays associated with a second quantity of said first sections, said second quantity being at least one, a second designated award associated with each of a first quantity of said second sections, said first quantity of said second sections being at least one;

(4) operate with the at least one display device to display a play of a game, wherein the award displays, the sections of the award displays, and the probabilities of being indicated are configured such that the first designated awards and the second designated award have a same probability of being won before and for the play of the game; and the display of the play of the game including:

(a) activating the first award displays and indicating one of the sections of said first award display, (b) when the indicated section of the first award display is associated with the first designated award, providing said designated award to a player, (c) when the indicated section of the first award display is associated with the transfer to one of the plurality of award displays, activating said one of the plurality of award displays and indicating one of the sections of said one of the plurality of award displays; and (5) adjust the credit balance based on the play of the game.

7. The gaming system of claim 6, wherein the award displays are wheels.

8. The gaming system of claim 6, wherein the designated awards are different awards.

9. The gaming system of claim 6, wherein the designated awards are different progressive awards.

10. The gaming system of claim 6, wherein at least one of the award displays does not have any transfers to any other of the award displays.

11. The gaming system of claim 6, which includes at least three award displays, wherein the award displays have a first order of activation and a second order of activation;

the first order of activation is from the first award display to the second award display to the third award display; and the second order of activation is from the first award display directly to the third award display.

12. A method of operating a gaming system, said method comprising:

causing at least one processor to operate with at least one display device to display:

(i) a first award display, said first award display including a plurality of sections, each section having a same first probability of being indicated, a first designated award associated with each of a first quantity of said sections of the first award display, said first quantity being at least one, a transfer to a second award display associated with a second quantity of said sections of the first award display, said second quantity being at least one, and a plurality of other awards associated with a third quantity of said sections of the first award display, said third quantity being at least one, and (ii) the second award display, said second award display including a plurality of sections, each section having a same second probability of being indicated, a second designated award associated with each of a fourth quantity of said sections of the second award display, said fourth quantity being at least one, and a plurality of other awards associated with a fifth quantity of said sections of the second award display, said fifth quantity being at least two, and (iii) a credit balance, said credit balance being increasable via an acceptor of a physical item associated with a monetary value, and said credit balance being decreasable via a cashout device; and causing the at least one processor to operate with the at least one display device to display a play of a game, wherein the first award display, the sections of the first award display, the second award display, the sections of the second award display, the first probability, and the second probability are configured such that the first designated award and the second designated award have a same probability of being won before and for the play of the game;

the display of the play of the game including:

(a) activating the first award display and indicating one of the sections of said first award display, (b) when the indicated section of the first award display is associated with the first designated award, providing said first designated award to a player, (c) when the indicated section of the first award display is associated with one of the other awards, providing said award to the player, and (d) when the indicated section of the first award display is associated with the transfer to the second award display, activating the second award display and indicating one of the sections of said second award display, and (i) when the indicated section of the second award display is associated with the second designated award, providing said second designated award to the player, and (ii) when the indicated section of the second award display is associated with one of the other awards, providing said award to the player; and causing the at least one processor to adjust the credit balance based on the play of the game.

13. The method of claim 12, wherein the award displays are wheels.

14. The method of claim 12, wherein the first designated award and the second designated awards are different awards.

15. The method of claim 12, wherein the first designated award and the second designated award are different progressive awards.

16. The method of claim 12, which includes causing the at least one processor to operate with the at least one display device to display a third award display, said third award display including a plurality of sections, each section having a same third probability of being indicated, a third designated award associated with each of a sixth quantity of said sections of the third award display, said sixth quantity being at least one, a transfer to the first award display associated with a seventh quantity of said sections of the third award display, said seventh quantity being at least one, and a plurality of other awards associated with an eighth quantity of said sections of the third award display, said eighth quantity being at least two, and wherein the display of the play of the game includes: (a) before activating the first award display, activating the third award display and indicating one of the sections of said third award display, and (b) when the indicated section of the third award display is associated with the transfer to the first award display, activating the first award display.

17. The method of claim 13, which is provided through a data network.

18. The method of claim 17, wherein the data network is an internet.

19. A method of operating a gaming system, said method comprising:

causing at least one processor to:

(1) adjust a credit balance, said credit balance being increasable via an acceptor of a physical item associated with a monetary value, and said credit balance being decreasable via a cashout device; and (2) operate with at least one display device to display a plurality of award displays, each said award display including a plurality of sections, for each award display, each section of said award display having a same probability of being indicated, a first designated award associated with each of a first quantity of said sections of a first one of said award displays, said first quantity being at least one, a transfer to another one of the award displays associated with a second quantity of said sections of at least one of the award displays, said second quantity being at least one, and a plurality of other awards associated with a third quantity of said sections of said award displays, said third quantity being at least two;

causing the at least one processor to operate with the at least one display device to display a play of a game, wherein the award displays, the sections of the award displays, the probabilities of being indicated are configured such that each of the designated awards have a same probability of being won before and for the play of the game; and the display of the play of the game including:

(a) activating a first one of the award displays and indicating one of the sections of said activated award display, (b) when the indicated section of the activated award display is associated with the one of the designated awards, providing said designated award to a player, (c) when the indicated section of the activated award display is associated with one of the other awards, providing said award to the player, and (d) when the indicated section of the activated award display is associated with the transfer to another one of the award displays, activating said other award display and indicating one of the sections of said other award display, and repeating (b) to (d) until one of the designated awards or other awards is provided to the player; and causing the at least one processor to adjust the credit balance based on the play of the game.

20. The method of claim 19, wherein the award displays are wheels.

21. The method of claim 19, wherein the designated awards are different awards.

22. The method of claim 19, wherein the designated awards are different progressive awards.

23. The method of claim 19, wherein at least one of the award displays does not have any transfers to any other of the award displays.

24. The method of claim 19, which includes at least three award displays, wherein the award displays have a first order of activation and a second order of activation;

the first order of activation is from the first award display to the second award display to the third award display;

the second order of activation is from the first award display directly to the third award display.

25. The method of claim 19, which is provided through a data network.

26. The method of claim 25, wherein the data network is an internet.

27. The gaming system of claim 5, wherein the first award display includes at least one transfer to the third away display.

28. The gaming system of claim 1, wherein the second quantity of the first award display is at least two.

29. The gaming system of claim 1, wherein the second quantity of the first award display is at least two, wherein each of the second quantity of sections of the first award display includes a multiplier effect; wherein at least one multiplier effect is greater than another multiplier effect.

30. The gaming system of claim 1, wherein the instructions are configured to automatically adjust the second quantity of the first award display, depending on a measured input.

* * * * *